US008201497B2

(12) United States Patent
Suzuki et al.

(10) Patent No.: US 8,201,497 B2
(45) Date of Patent: Jun. 19, 2012

(54) STENCIL DISCHARGING BOX, STENCIL RECEIVING APPARATUS, AND STENCIL PRINTING APPARATUS

(75) Inventors: Kenji Suzuki, Tokyo (JP); Shigenori Ishii, Tokyo (JP)

(73) Assignee: Riso Kagaku Corporation, Tokyo (JP)

( * ) Notice: Subject to any disclaimer, the term of this patent is extended or adjusted under 35 U.S.C. 154(b) by 527 days.

(21) Appl. No.: 12/216,723

(22) Filed: Jul. 10, 2008

(65) Prior Publication Data

US 2009/0020025 A1 Jan. 22, 2009

(30) Foreign Application Priority Data

Jul. 20, 2007 (JP) ..... 2007-189651

(51) Int. Cl.
*B41L 13/06* (2006.01)

(52) U.S. Cl. ..... 101/114; 101/116

(58) Field of Classification Search ..... 101/114, 101/116, 117, 118, 119, 120, 477, 479, 480
See application file for complete search history.

(56) References Cited

U.S. PATENT DOCUMENTS 5,090,310 A * 2/1992 Motoe ..... 101/114
5,713,274 A * 2/1998 Kawai et al. ..... 101/114
5,901,645 A * 5/1999 Takahashi et al. ..... 101/114
5,964,148 A * 10/1999 Ishii ..... 101/116
6,067,901 A * 5/2000 Takahashi ..... 101/114
6,634,287 B2 * 10/2003 Mizutani et al. ..... 101/114

FOREIGN PATENT DOCUMENTS

JP H06-199029 7/1994
JP H11-198512 7/1999
JP 2002036700 A * 2/2002
JP 2002-79735 3/2002
JP 2002-103770 4/2002

* cited by examiner

*Primary Examiner* — Ren Yan
(74) *Attorney, Agent, or Firm* — Manabu Kanesaka

(57) ABSTRACT

The present invention provides an easy-to-use stencil discharging box that can easily be detached from a printing apparatus with one hand, and can smoothly execute vertical discard in this state. A stencil discharging box that is detachably mounted to a printing apparatus for receiving a used stencil compressed by compressing means of the printing apparatus is detached from the apparatus. When an operation lever is depressed, a cover member provided to an upper opening of a main body moves in an upward direction to open the opening, and a stencil moving member integrally formed with the cover member pivots in a frontward and upward-direction from between compression ribs of the main body so as to lift up the used stencil sticking to the ribs in the main body. When the main body is tilted with a discharge port provided at one side face of the main body (at the near side in the figure) facing downward, the used stencil can be discharged to the outside (vertical discard).

10 Claims, 19 Drawing Sheets

STENCIL DISCHARGING BOX, STENCIL RECEIVING APPARATUS, AND STENCIL PRINTING APPARATUS

FIELD OF THE INVENTION

The present invention relates to a stencil discharging box (stencil receiving apparatus) that is detachably attached to a printing apparatus in which a printing plate that is subject to plate-making is mounted to printing means for performing a printing operation, and that receives a used printing plate (used stencil) removed from the printing means as compressing the same by compressing means at the printing apparatus, and a stencil printing apparatus provided with the stencil discharging box (stencil receiving apparatus). In particular, the present invention relates to a stencil discharging box (stencil receiving apparatus) in which a used stencil can be discharged from a discharge port formed at the side face in the compressing direction of the used stencil, not from an inlet side of the used stencil, upon detaching the stencil discharging box from the printing apparatus, and a stencil printing apparatus provided with the stencil discharging box (stencil receiving apparatus).

BACKGROUND OF THE INVENTION

A printing apparatus to which a printing plate that is subject to plate-making is attached to printing means for performing a printing operation generally includes a stencil discharging box for receiving used printing plates (used stencils). In the printing apparatus described above, the used stencil that is unnecessary after the completion of the printing operation is removed from the printing means and stored in the stencil discharging box as compressed. The stencil discharging box is generally detachable to the printing apparatus in order to discharge the used stencil. Patent Documents 1 and 2 described below illustrate the conventional stencil discharging box described above.

Patent Document 1 (Japanese Unexamined Patent Application No. 2002-96542) discloses a stencil discharging box having an integral simplified structure in which a single plate member having elasticity is folded so as to have generally a U-shaped section. This stencil discharging box is detachably mounted to the printing apparatus by utilizing its elasticity, wherein the gap at the front end is suitably opened to receive a used stencil when it is mounted. In order to detach the box from the printing apparatus, the gap at the front end is closed by the hand-gripping force, so that the used stencil is prevented from being dropped to the outside. When a user loosens his/her grip after he/she carries the box to a discarding position, the used stencil inside can be discarded from the opened gap at the front end.

Patent Document 2 (Japanese Unexamined Patent Application No. Hei 11-198512) discloses a stencil discharging box that is detachably mounted to a printing apparatus and has a box-like main body. A used stencil sent toward the inside of the stencil discharging box is compressed by a compressing plate that moves along an inner circumference plane. When the used stencil is discarded, a user pulls a handle, provided to the main body, with one hand to draw the box in the near side of the printing apparatus so as to remove the box, and then, operates another handle with the other hand to move a pushing member at the inside of the main body, whereby the used stencil is pushed and discarded to the outside from the main body in the direction orthogonal to the stencil receiving direction.

The stencil discharging box disclosed in Patent Document 1 is detachably mounted to the printing apparatus with one hand as described above. Further, when a user loosens his/her grip to the stencil discharging box and opens the front opening, the used stencil can be discharged and discarded from the inlet (the manner in which the used stencil is discarded in the direction reverse to the receiving direction of the used stencil is referred to as "lateral discard"). However, when the used stencil bites between ribs, which are formed at the surface in the box for preventing the used stencil from sticking, due to the compression of the used stencil, the used stencil inside might not be discharged just by tilting the box with the front opening opened. Thus, the problem might occur in the reliability of discarding work.

The stencil discharging box has a simple structure in which a single plate is folded into a U-shape, and according to the balance between the elasticity and the grip of the user, this box is attached to or detached from the printing apparatus or prevents the used stencil from being dropped upon the detachment. Therefore, the box might not appropriately be attached to or detached from the printing apparatus, or the used stencil might be dropped upon the detachment, depending upon the discretion of the user.

Since the stencil discharging box is formed from a single plate that is folded into a U-shape, both side faces are open, and it can be considered that the used stencil is discharged and discarded from the openings (the manner in which the used stencil is discarded from the opening, having a narrow width, at the side face in the direction different from the receiving direction of the used stencil is referred to as "vertical discard"). However, when the used stencil is compressed and bites between the ribs that are formed at the surface in the box for preventing the used stencil from sticking, a greater resistance is applied to the case of the vertical discard than the lateral discard, in which the used stencil is discarded in the direction orthogonal to the longitudinal direction in which the ribs extend, so that the vertical discard cannot actually be executed.

According to the stencil discharging box described in Patent Document 2, when the used stencil is discarded, a user pulls a handle, provided to the main body, with one hand to draw the box in the near side of the printing apparatus so as to remove the box, and then, operates another handle with the other hand to push and discard the used stencil to the outside from the main body. As described above, both hands has to be used in the stencil discharging box in order to discard the used stencil to the outside of the box, which makes the work complicated.

SUMMARY OF THE INVENTION

The present invention is accomplished in view of the above-mentioned problems, and aims to provide an easy-to-use stencil discharging box that has a simple structure, can easily be detached from a printing apparatus with one hand without dropping a used stencil, can smoothly execute vertical discard by a simple operation with the same one hand without getting the used stencil caught, and can easily be attached to the printing apparatus with the same one hand after the discard, and a stencil printing apparatus provided with the stencil discharging box.

A stencil discharging box of a first aspect that is detachably mounted to a printing apparatus for receiving a used stencil sent from the printing apparatus includes:

a main body that includes an upper opening into which compressing means is inserted for compressing the sent used stencil with the compressing means of the printing apparatus, a facing section for receiving the stencil, the facing section being located at a position facing the compressing means in a compressing direction of the compressing means, a bottom section having a shape along a locus of the compressing means, a discharging section of a used stencil provided to at least one of both side faces parallel to the compressing direction, plural bottom ribs formed at the bottom section so as to extend in the same direction as the compressing direction, and plural facing section ribs formed at the section for receiving the stencil;

a stencil moving member that is movable between a standby position in which the stencil moving member is inserted at a position lower than the height of the facing section rib and a lift-up position in which the stencil moving member projects from the height of the facing section rib; and an operation lever for moving the stencil moving member.

The stencil discharging box of a second aspect is characterized in that, in the stencil discharging box according to the first aspect, the stencil moving member is provided at a position near the discharging section in a direction orthogonal to the compressing direction.

The stencil discharging box of a third aspect is characterized in that, in the stencil discharging box according to the second aspect, the stencil moving member is formed in plural numbers in the direction orthogonal to the compressing direction, and the length of the plate moving member, among the plural plate moving members, in the compressing direction provided at the position near the discharging section is longer than the length of the plate moving member provided at a position far from the discharging section.

The stencil discharging box of a fourth aspect is characterized in that, in the stencil discharging box according to any one of the first to third aspects, a cover member for covering the upper opening at a position not interfering the compressing operation by the compressing means is provided, and the cover member is movable to be opened and closed between an opening position for opening the upper opening and a closing position for covering the upper opening, and opens and closes the upper opening through the operation of the operation lever in interlocking with the stencil moving member.

The stencil discharging box of a fifth aspect is characterized by including, in the stencil discharging box according to the fourth aspect, an attachment/detachment lever having an attachment/detachment mechanism for attaching and detaching the stencil discharging box to and from the printing apparatus, wherein the operation lever is provided in the vicinity of the attachment/detachment lever.

The stencil discharging box of a sixth aspect is characterized in that, in the stencil discharging box according to the fifth aspect, a locking mechanism for inhibiting the operation of the attachment/detachment lever is provided to the attachment/detachment lever.

The stencil discharging box of a seventh aspect is characterized in that, in the stencil discharging box according to the sixth aspect, the plural bottom ribs are formed at a position other than the position near the discharge port in the direction orthogonal to the compressing direction.

The stencil discharging box of an eighth aspect is characterized in that, in the stencil discharging box according to the seventh aspect, an anti-return projection for preventing the compressed used stencil from returning to the upper opening is provided to the plural bottom ribs.

A stencil printing apparatus of a ninth aspect includes a printing drum, a detachable stencil discharging box, and compressing means that compresses a used stencil peeled off from the printing drum and stored in the stencil discharging box, wherein the stencil discharging box includes a main body that includes:

an upper opening into which the compressing means is inserted for compressing the sent used stencil by the compressing means; a facing section for receiving the stencil, the facing section being located at a position facing the compressing means in a compressing direction of the compressing means, a bottom section having a shape along a locus of the compressing means, a discharging section of a used stencil provided to at least one of both side faces parallel to the compressing direction, plural bottom ribs formed at the bottom section so as to extend in the same direction as the compressing direction, and plural facing section ribs formed at the section for receiving the stencil;

a stencil moving member that is movable between a standby position in which the stencil moving member is inserted at a position lower than the height of the facing section rib and a lift-up position in which the stencil moving member projects from the height of the facing section rib; and an operation lever for moving the stencil moving member.

A stencil receiving apparatus of a tenth aspect is configured to be detachably mounted to a main body of a printing apparatus for receiving a stencil discharged from the main body of the printing apparatus, including:

a stencil receiving container that has a bottom section for receiving the stencil, a facing section for receiving the stencil arranged at the bottom section for receiving the stencil so as to be opposite to a stencil receiving direction, a side section for receiving the stencil arranged at a side face of the bottom section for receiving the stencil, and a stencil discarding section provided at the side section for discharging the stencil;

an attachment/detachment operation section that is arranged at the stencil receiving container at a side of the facing section for receiving the stencil and used when the stencil receiving apparatus is attached to or detached from the main body of the printing apparatus;

a stencil moving section that is arranged at the stencil receiving container at the side of the facing section for receiving the stencil and moves the received stencil into the stencil receiving container; and a stencil moving operation section that is arranged at the stencil receiving container at the side of the facing section for receiving the stencil and operates the stencil moving section, wherein the stencil moving section is arranged in the facing section for receiving the stencil of the stencil receiving container, and is configured to move from the facing section for receiving the stencil toward a direction reverse to the stencil receiving direction through the operation of the stencil moving operation section.

A stencil receiving apparatus described in claim 10 is configured to be detachably mounted to a main body of a printing apparatus for receiving a stencil discharged from the main body of the printing apparatus, including:

a stencil receiving container that has a bottom section for receiving the stencil, a facing section for receiving the stencil arranged at the bottom section for receiving the stencil so as to be opposite to a stencil receiving direction, a side section for receiving the stencil arranged at a side face of the bottom section for receiving the stencil, and a stencil discarding section provided at the side section for discharging the stencil;

an attachment/detachment operation section that is arranged at the stencil receiving container at a side of the facing section for receiving the stencil and used when the stencil receiving apparatus is attached to or detached from the main body of the printing apparatus;

a stencil moving section that is arranged at the stencil receiving container at the side of the facing section for receiving the stencil and moves the received stencil into the stencil receiving container; and a stencil moving operation section that is arranged at the stencil receiving container at the side of the facing section for receiving the stencil and operates the stencil moving section, wherein the stencil moving section is arranged in the facing section for receiving the stencil of the stencil receiving container, and is configured to move from the facing section for receiving the stencil toward a direction reverse to the stencil receiving direction through the operation of the stencil moving operation section.

Figure 1:
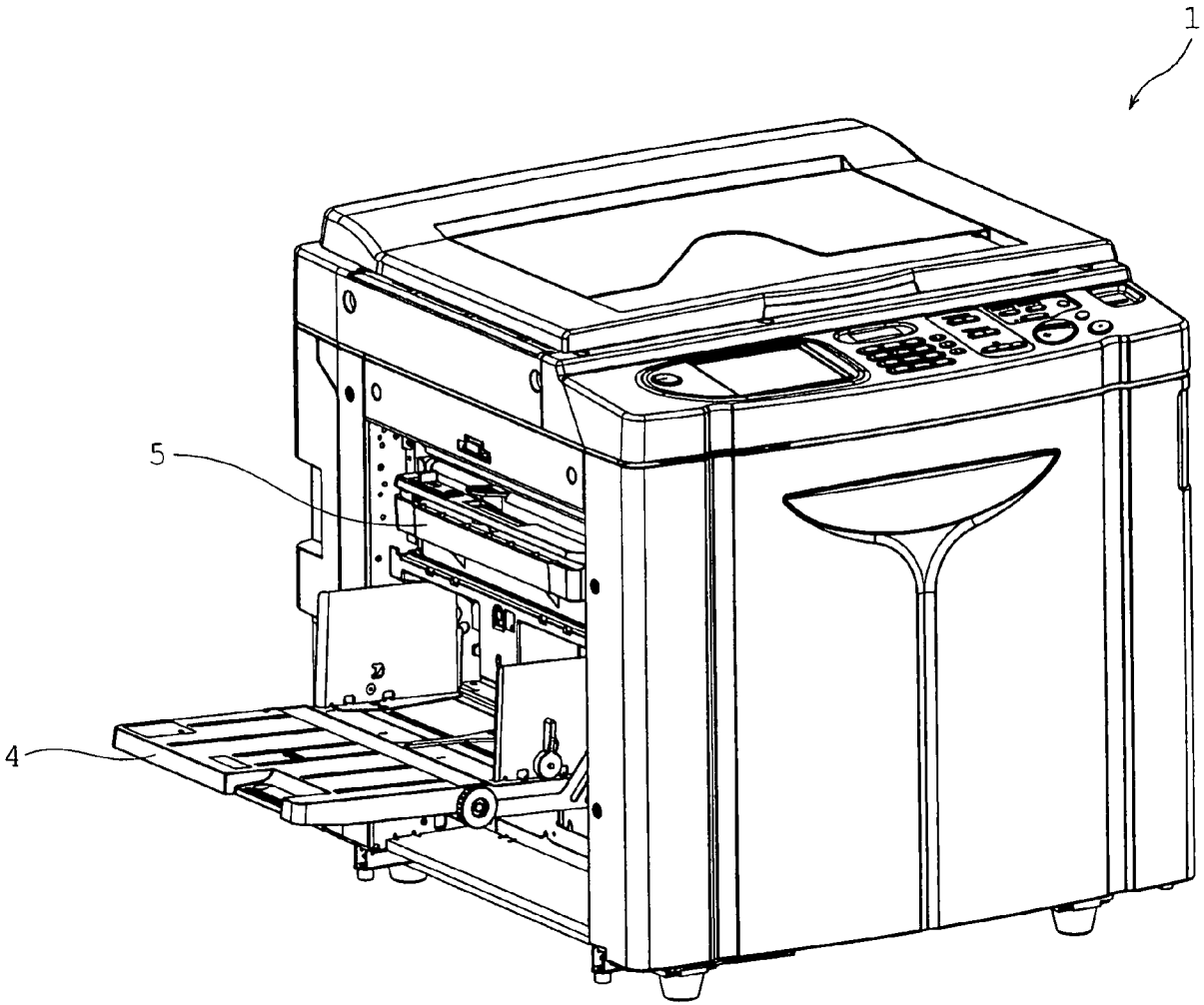
FIG. 1 is a perspective view of an overall stencil printing apparatus to which a stencil discharging box according to the embodiment is attached, wherein the state in which the stencil discharging box is attached is illustrated.

Each of the numerals given to some of the components in the embodiment denotes the components described below in the explanation of the embodiment with reference to the above-mentioned drawings. The word in the parentheses is the word in the constituent in claim 10 corresponding to the component in the embodiment.

1 Stencil printing apparatus
3 Compressing means
5, 5' Stencil discharging box (stencil receiving apparatus)
7 Main body (stencil receiving container)
8 Cover member
9, 9*a*, 9*b* Stencil moving member (stencil moving section)
10 Operation lever (stencil moving operation section)
11 Attachment/detachment lever (attachment/detachment operation section)
12 Bottom plate that is the bottom section of main body (bottom section for receiving a stencil)
13 Right side plate (side section for receiving a stencil)
14 Left side plate (side section for receiving a stencil)
15 Rear plate that is a compressing section (facing section for receiving a stencil) of main body
16 Discharge port that is discharging section (stencil discarding section) of main body
18*a* Bottom rib
18*b* Compression rib
19 Rib
20 Anti-return projection
23 Plate section
24 Arm section
25 Engagement member as attachment/detachment mechanism
26 Slide lever composing locking mechanism
27 Locking member composing locking mechanism
30 Upper opening
S Used stencil

DETAILED DESCRIPTION OF THE PREFERRED EMBODIMENTS

1. First Embodiment (FIGS. 1 to 15)

Figure 2:
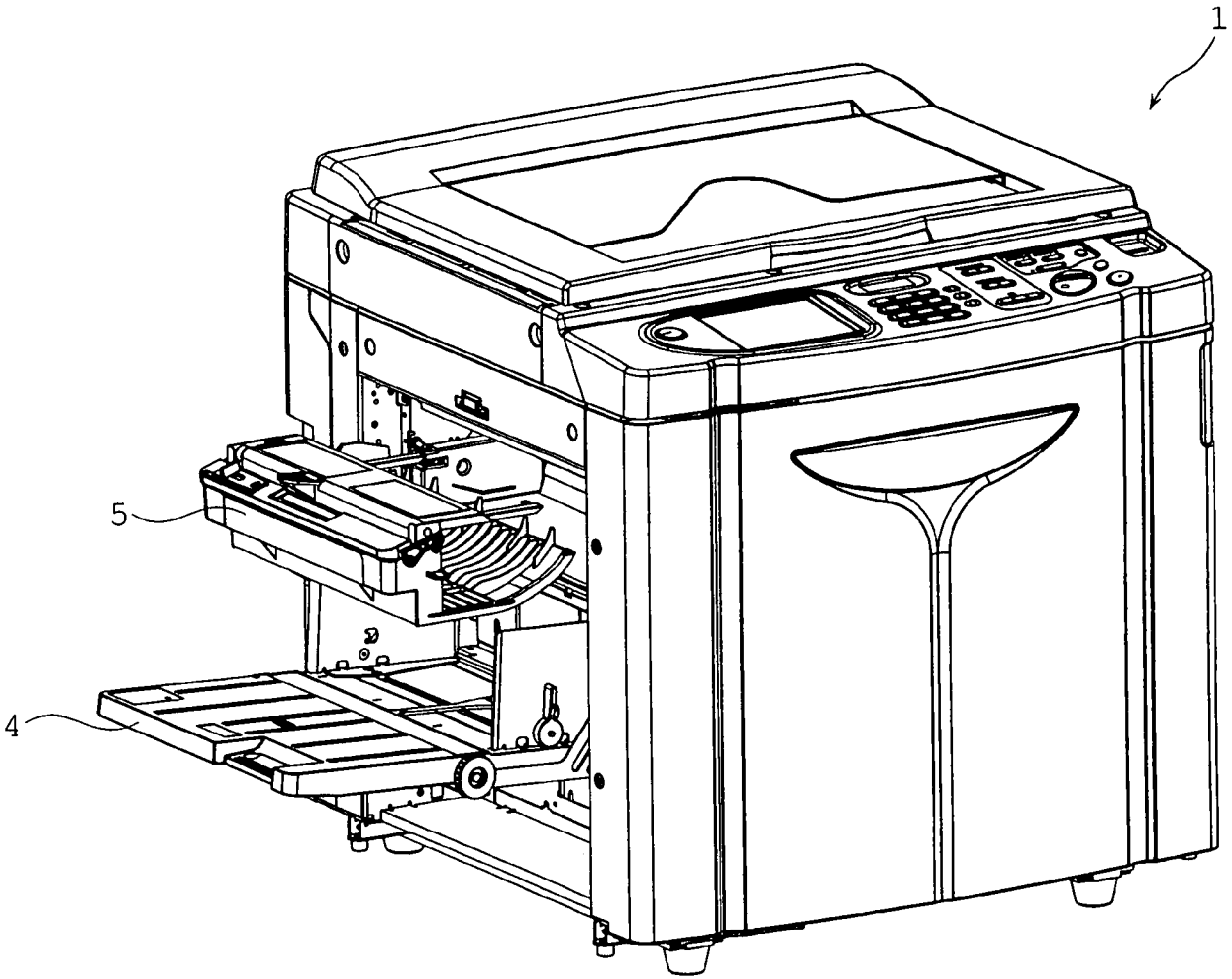
FIG. 2 is a perspective view of an overall stencil printing apparatus to which the stencil discharging box according to the embodiment is attached, wherein the state in which the stencil discharging box is detached is illustrated.
Figure 3:
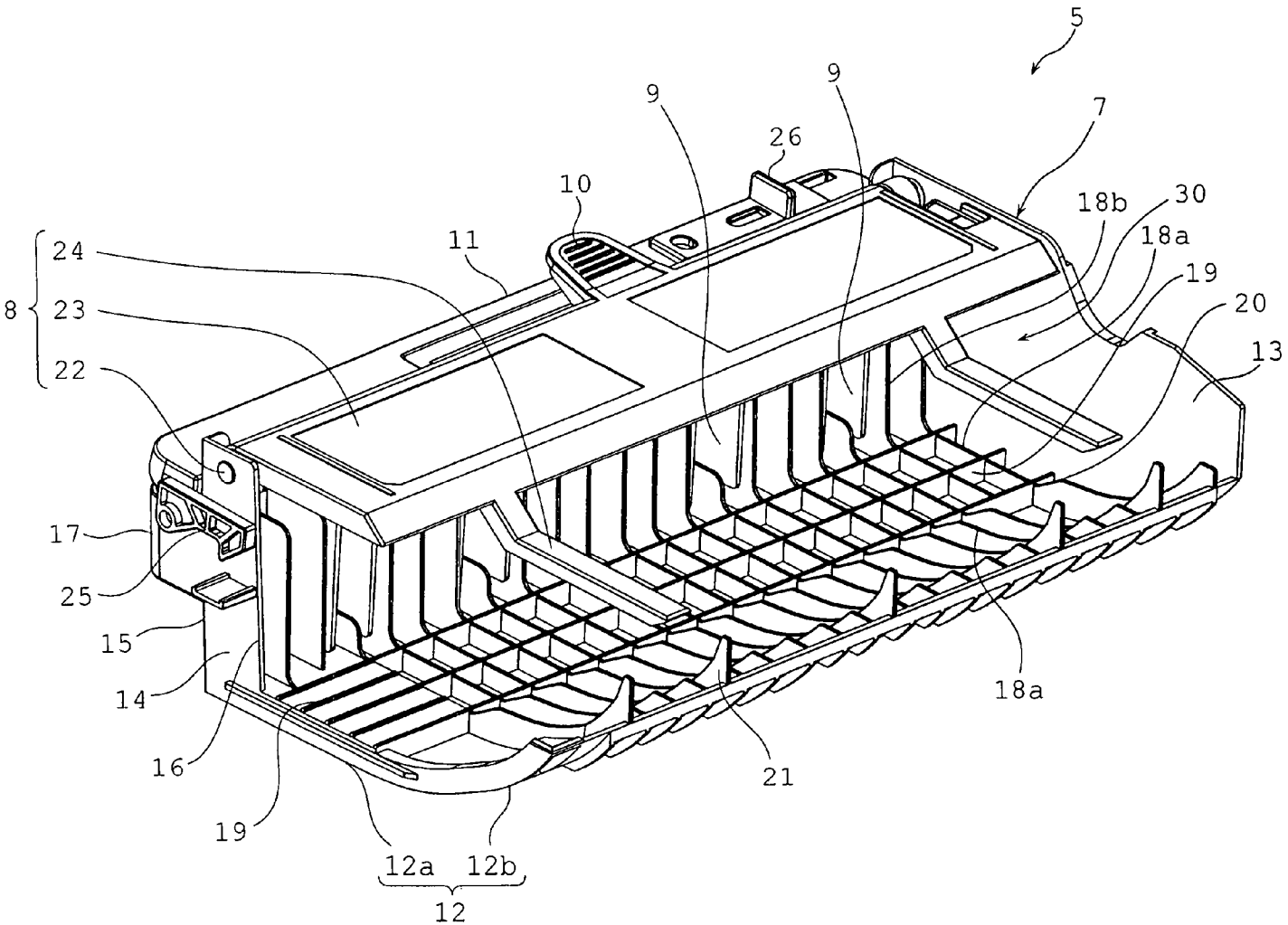
FIG. 3 is a perspective view of the stencil discharging box according to the embodiment viewed from the front.
Figure 4:
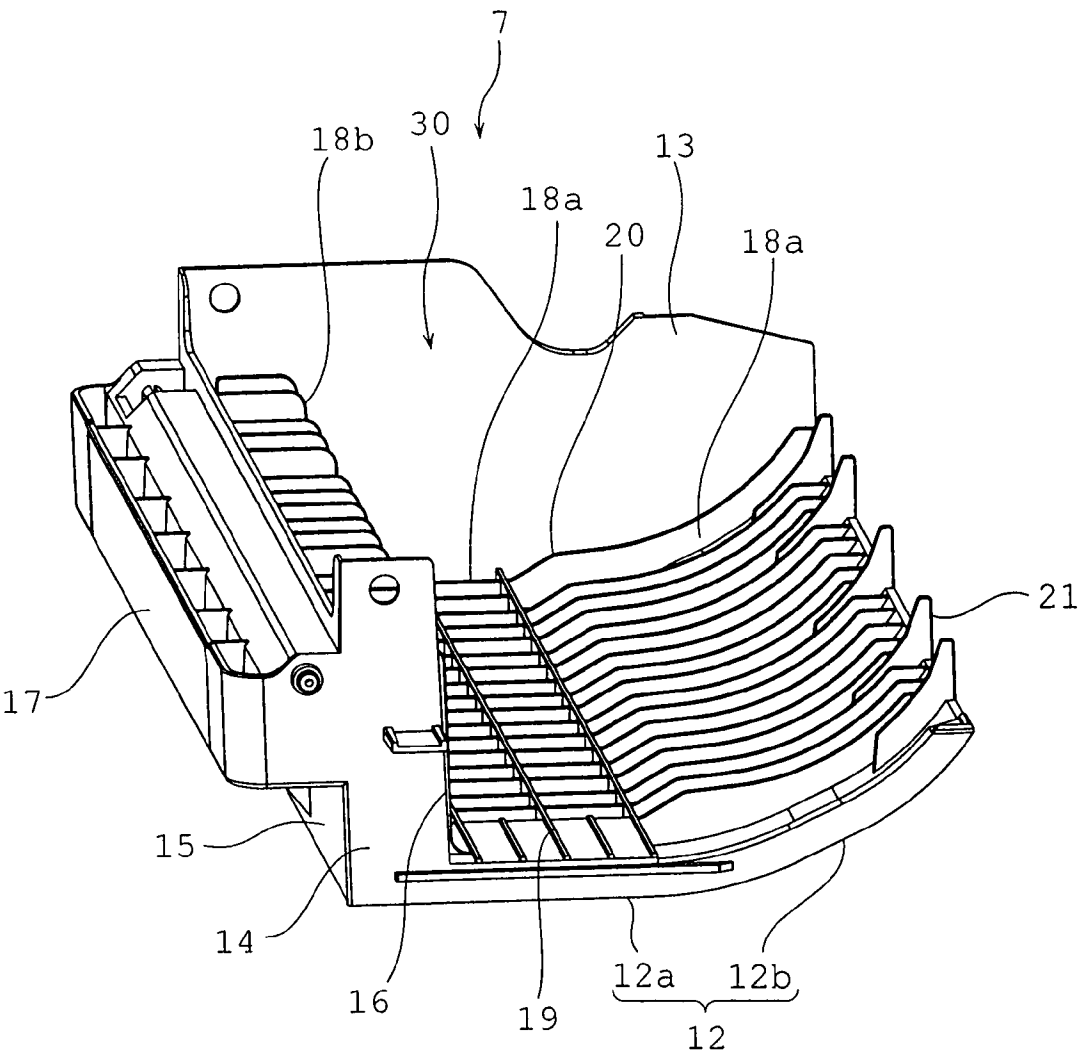
FIG. 4 is a perspective view of a main body of the stencil discharging box according to the embodiment.
Figure 5A:
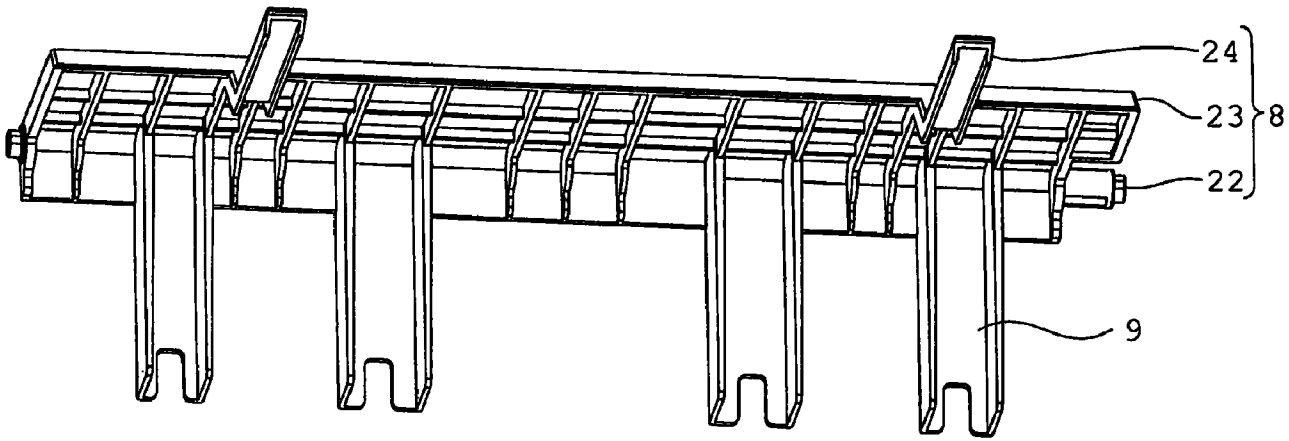
FIGS. 5A and 5B are perspective views of a cover member of the stencil discharging box according to the embodiment.
Figure 5B:
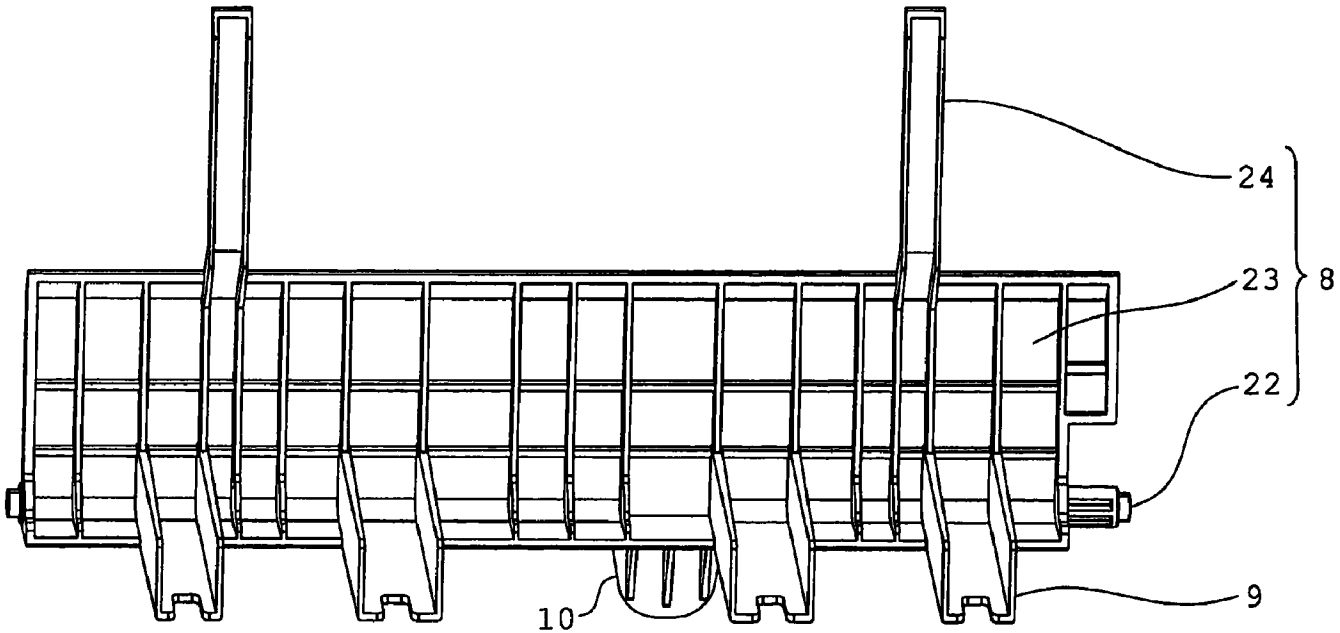
Figure 6:
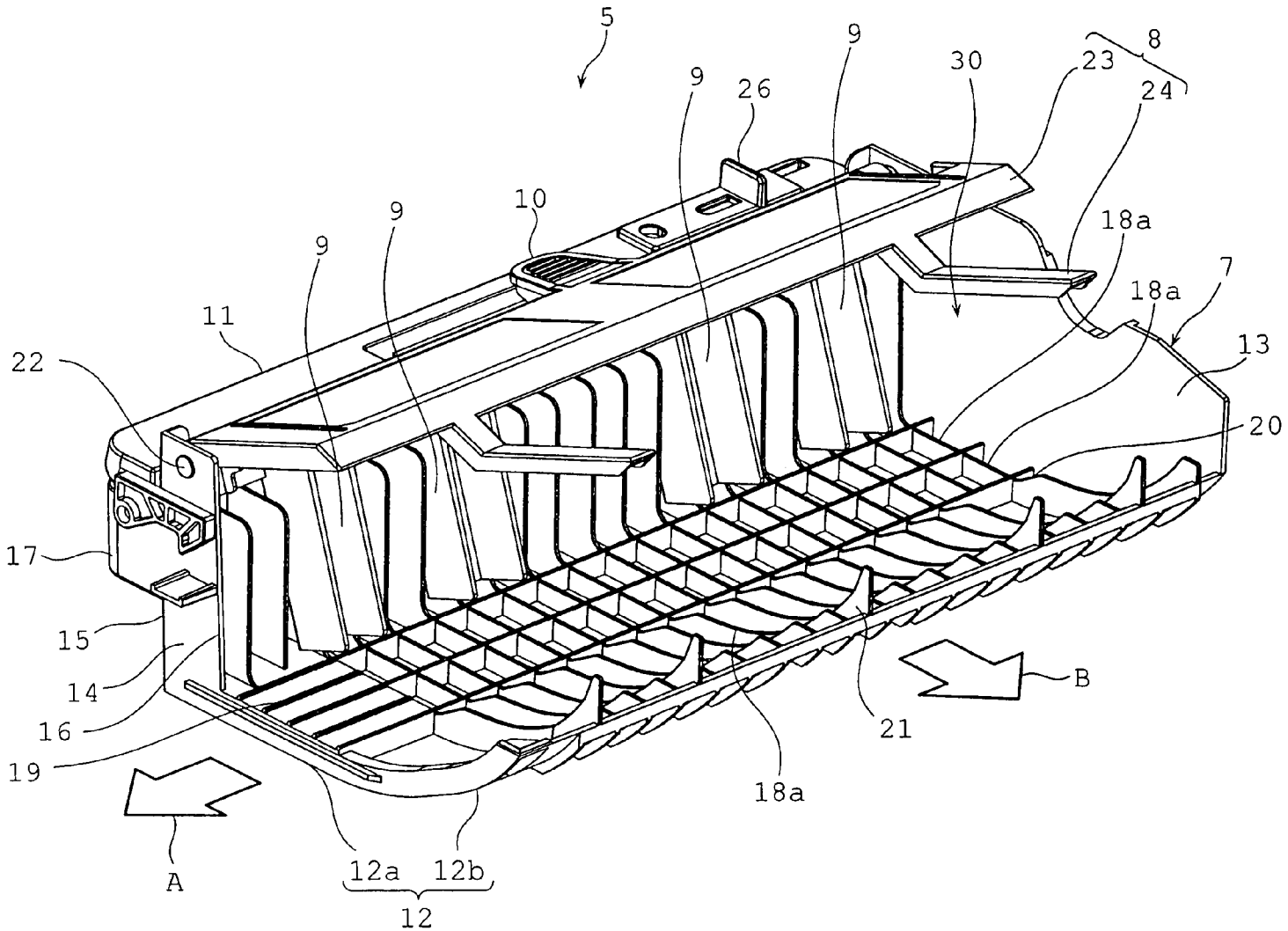
FIG. 6 is a perspective view showing the state, viewed from the front, in which the cover member or the like of the stencil discharging box according to the embodiment is opened.
Figure 7:
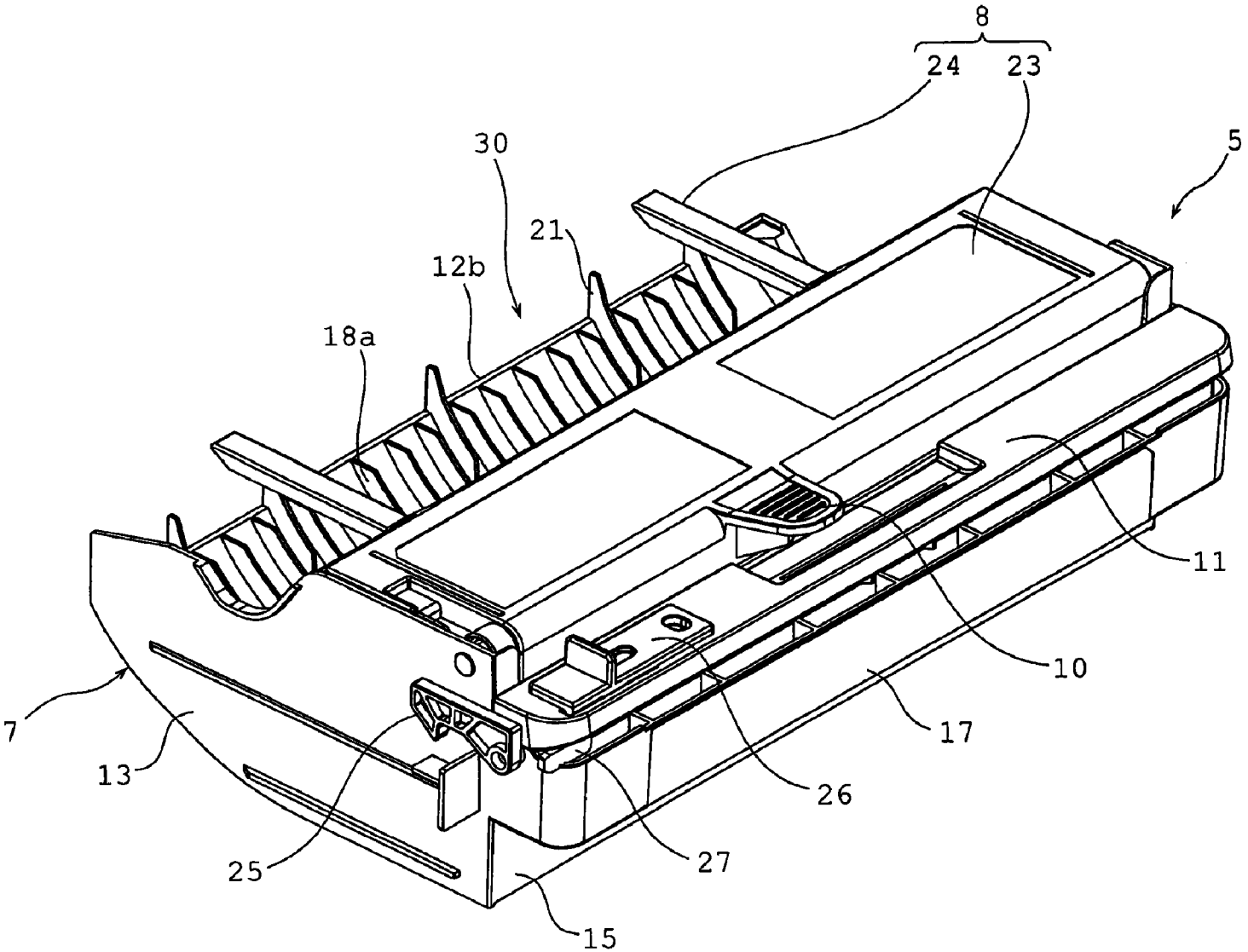
FIG. 7 is a perspective view of the stencil discharging box according to the embodiment, viewed from the rear, which is in locked state to the printing apparatus.
Figure 8:
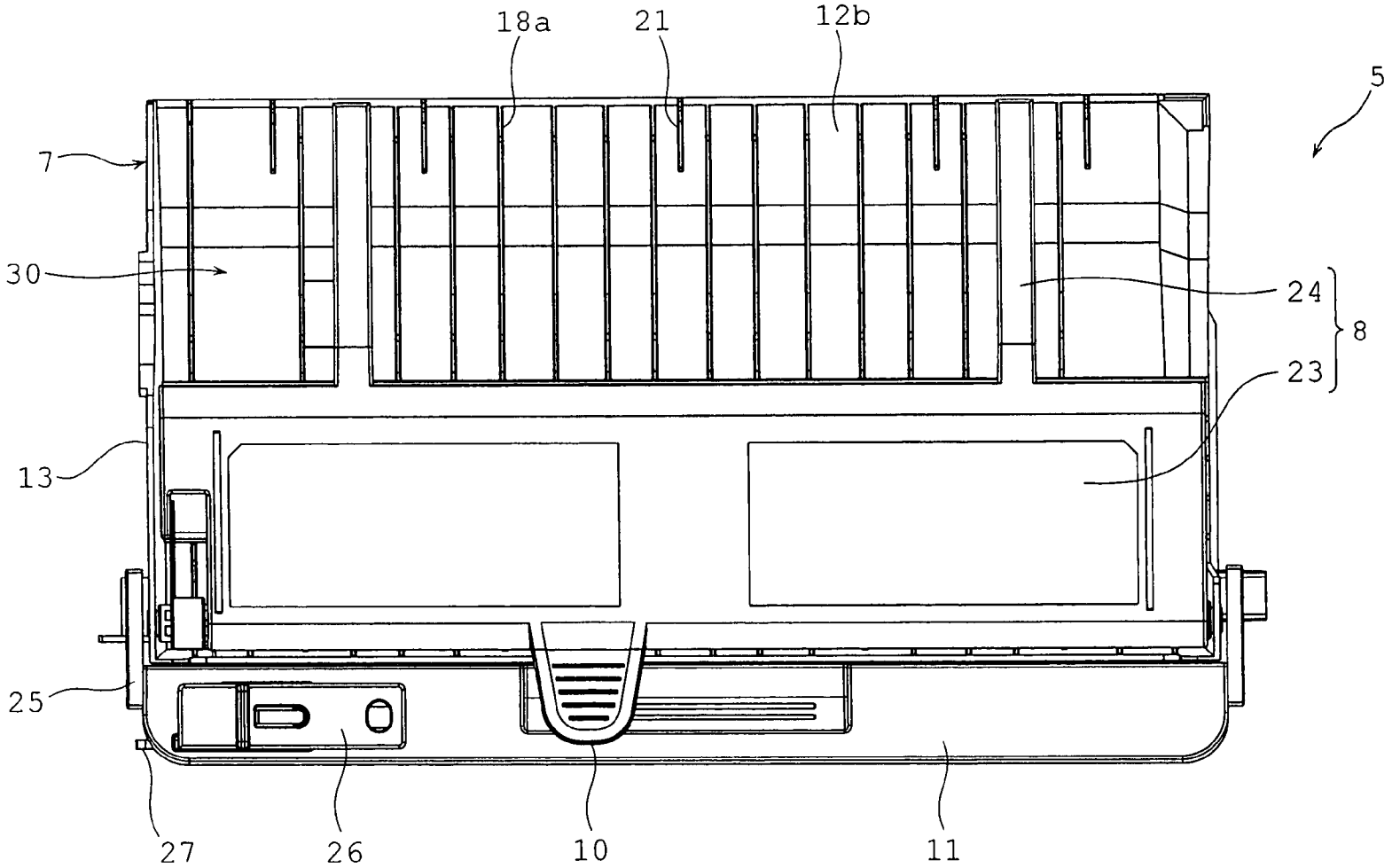
FIG. 8 is a plan view of the stencil discharging box according to the embodiment, which is in locked state to the printing apparatus.
Figure 9:
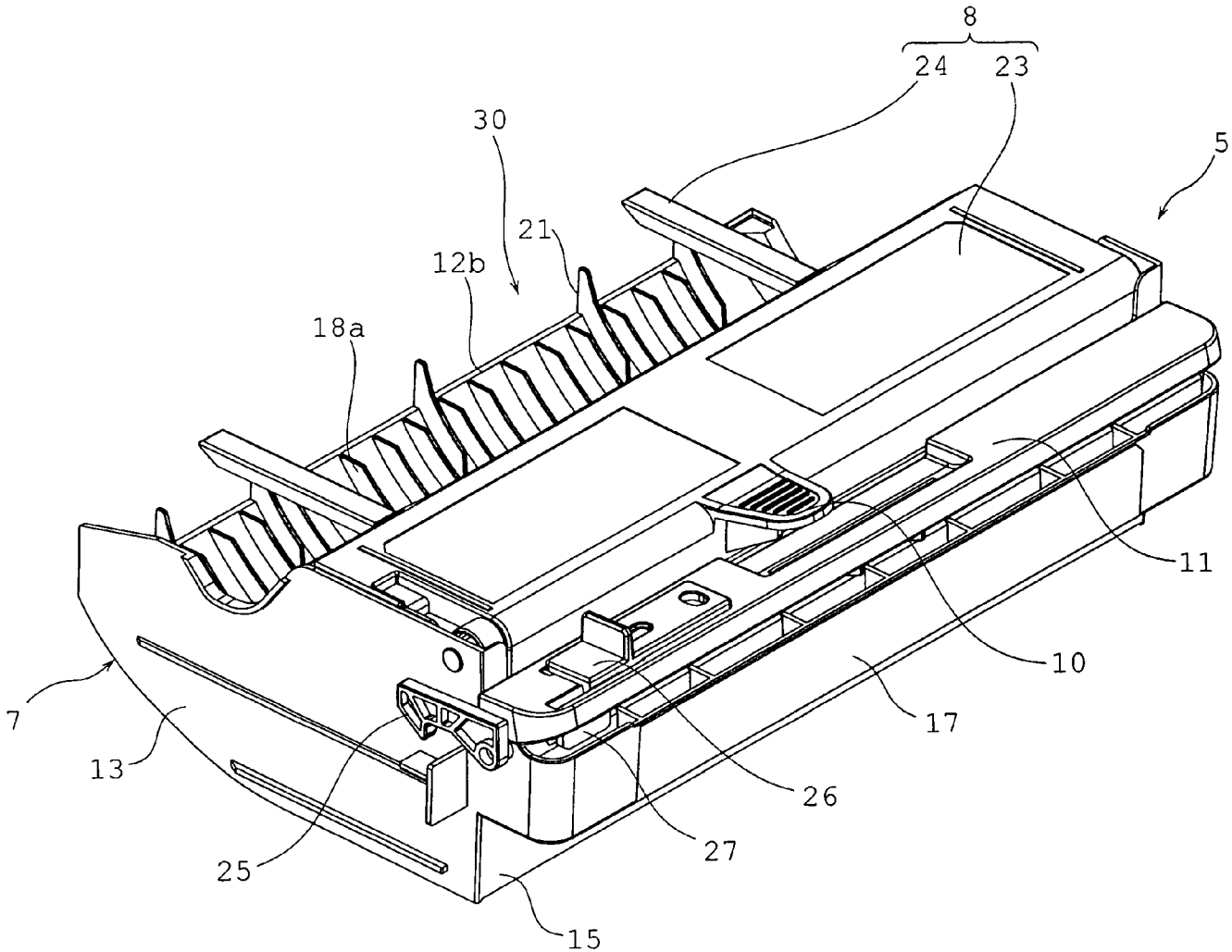
FIG. 9 is a perspective view of the stencil discharging box according to the embodiment, viewed from the rear, which is unlocked to the printing apparatus.
Figure 10:
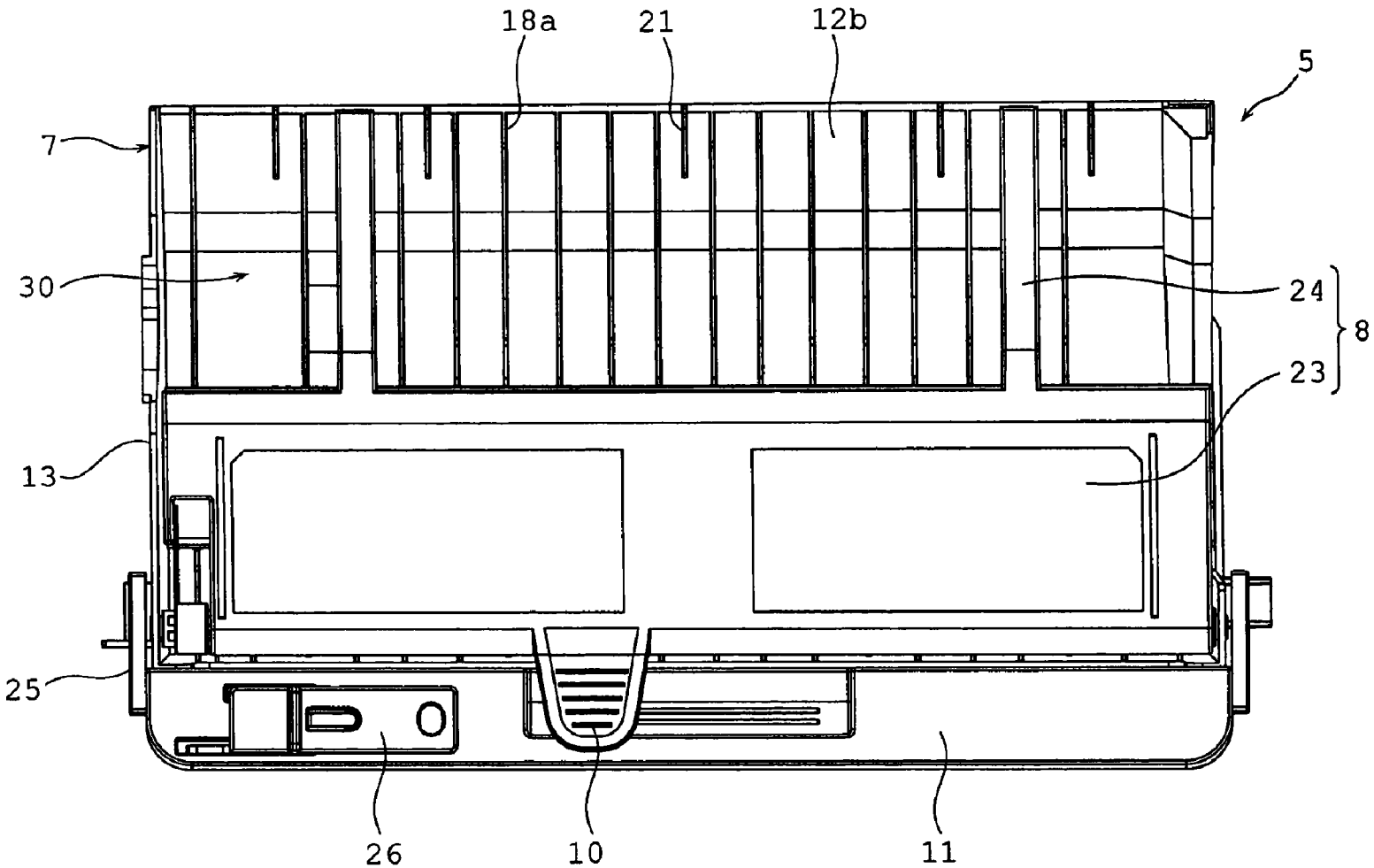
FIG. 10 is a plan view of the stencil discharging box according to the embodiment, which is unlocked to the printing apparatus.
Figure 11:
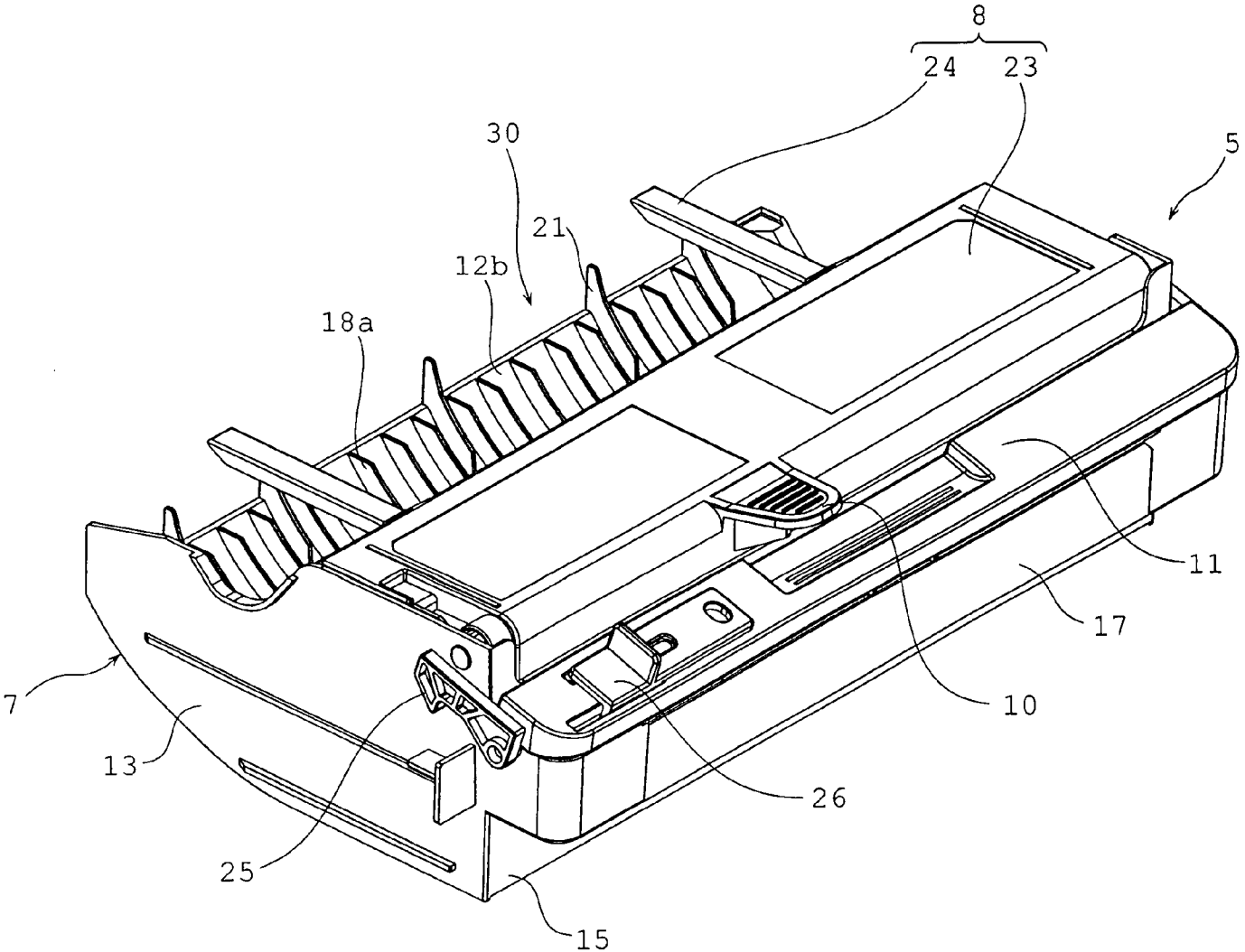
FIG. 11 is a perspective view of the stencil discharging box according to the embodiment that is in a state of being drawable from the printing apparatus, viewed from the rear.
Figure 14:
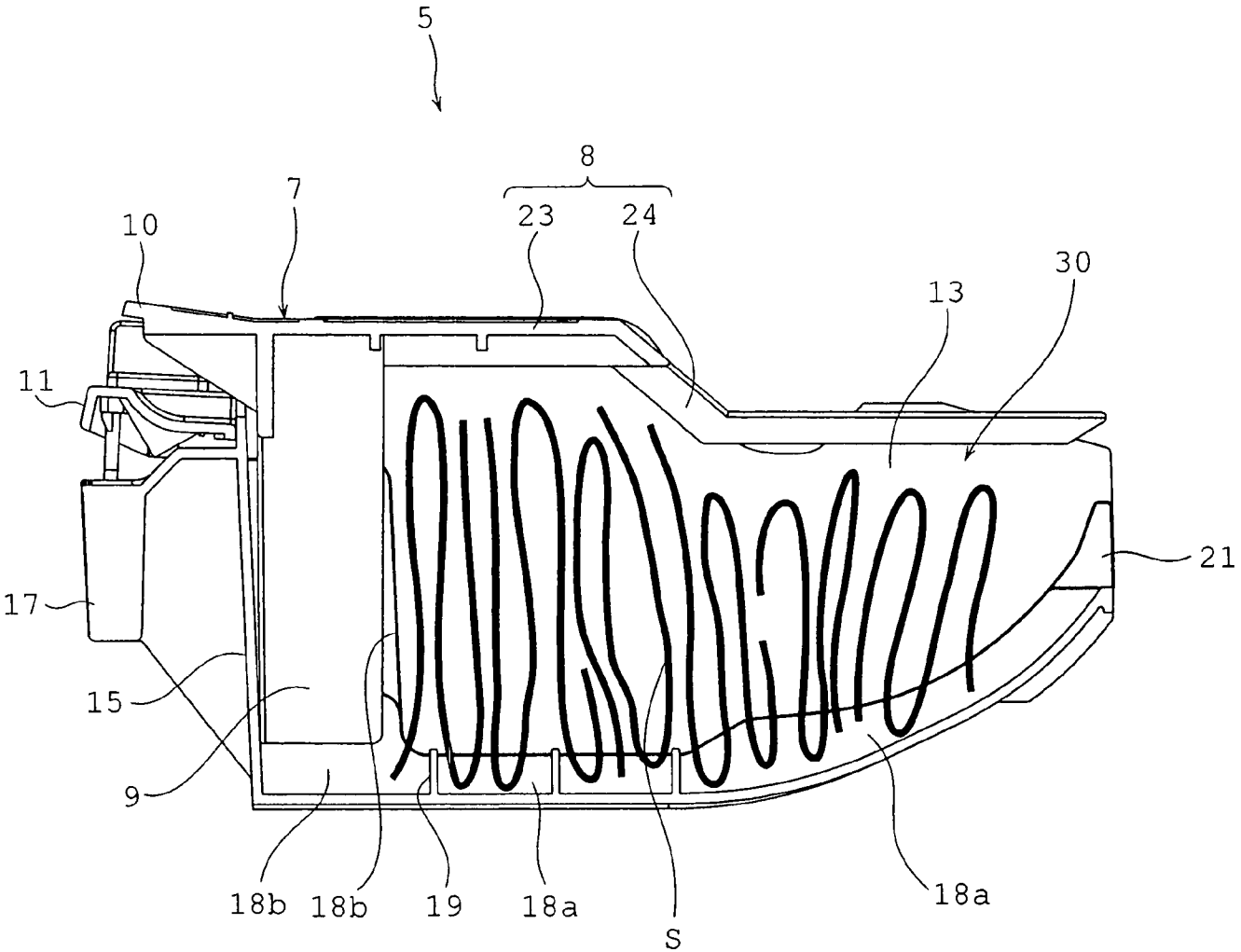
FIG. 14 is a sectional view, viewed from the front, showing the stencil discharging box according to the embodiment that is detached from the printing apparatus.
Figure 15:
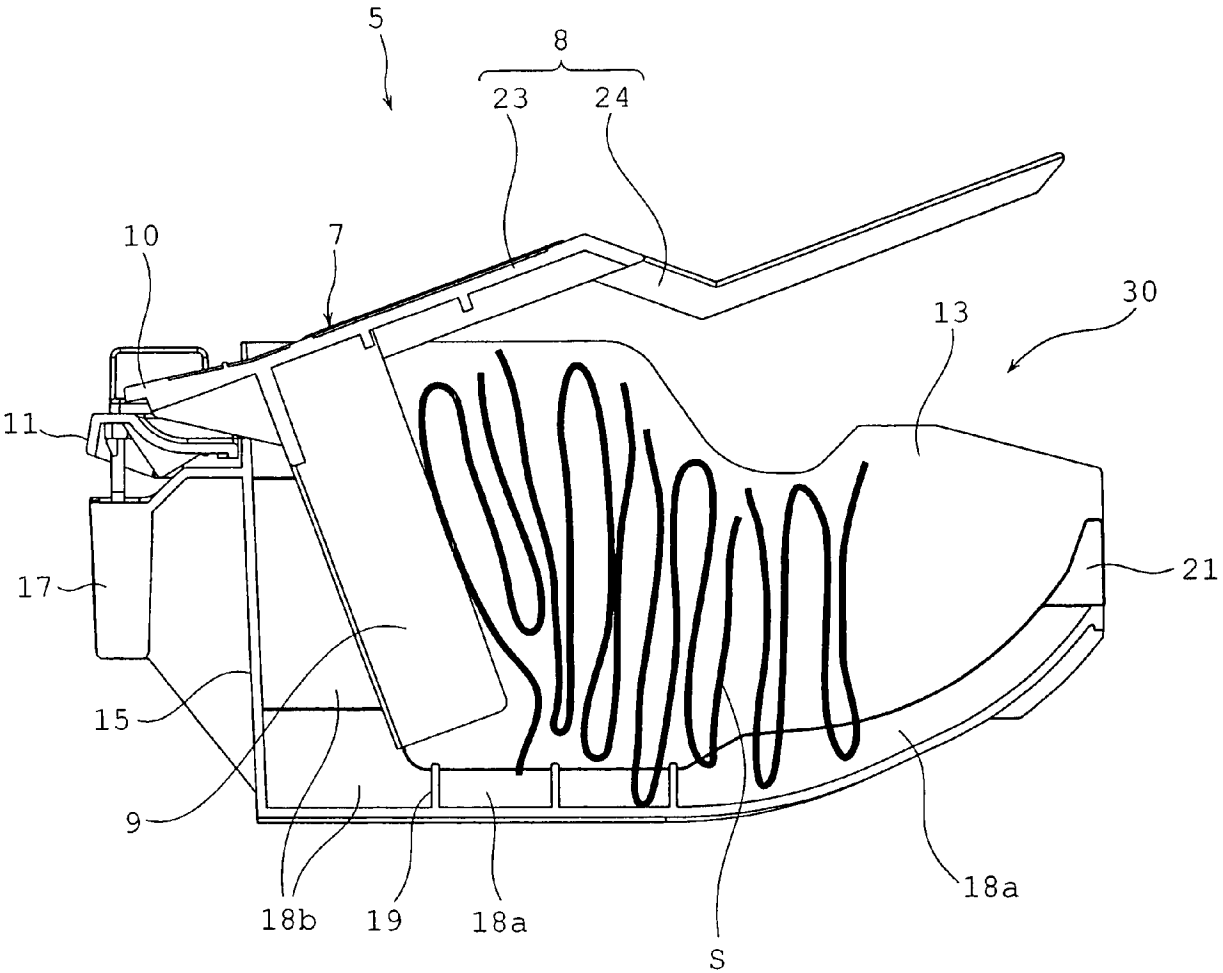
FIG. 15 is a sectional view, viewed from the front, showing the state in which the cover member or the like is opened upon the discard of the used stencil in the stencil discharging box according to the embodiment detached from the printing apparatus.

FIGS. 1 and 2 are perspective views of an overall stencil printing apparatus to which a stencil discharging box according to the embodiment is attached, wherein FIG. 1 shows the state in which the stencil discharging box is attached, while FIG. 2 shows the state in which the stencil discharging box is detached. FIG. 3 is a perspective view of the stencil discharging box according to the embodiment viewed from the front, FIG. 4 is a perspective view of a main body of the stencil discharging box according to the embodiment, FIGS. 5A and 5B are perspective views of a cover member of the stencil discharging box according to the embodiment, FIG. 6 is a perspective view showing the state, viewed from the front, in which the cover member or the like of the stencil discharging box according to the embodiment is opened, FIG. 7 is a perspective view of the stencil discharging box according to the embodiment, viewed from the rear, which is in locked state to the printing apparatus, FIG. 8 is a plan view of the stencil discharging box according to the embodiment, which is in locked state to the printing apparatus, FIG. 9 is a perspective view of the stencil discharging box according to the embodiment, viewed from the rear, which is unlocked to the printing apparatus, FIG. 10 is a plan view of the stencil discharging box according to the embodiment, which is unlocked to the printing apparatus, FIG. 11 is a perspective view of the stencil discharging box according to the embodiment that is in a state of being drawable from the printing apparatus, viewed from the rear, FIG. 12 is a sectional view, viewed from the front, showing the state in which compressing means is not operated in the stencil discharging box according to the embodiment that is attached to the printing apparatus, FIG. 13 is a sectional view, viewed from the front, showing the state in which compressing means is operated in the stencil discharging box according to the embodiment that is attached to the printing apparatus, FIG. 14 is a sectional view, viewed from the front, showing the stencil discharging box according to the embodiment that is detached from the printing apparatus, and FIG. 15 is a sectional view, viewed from the front, showing the state in which the cover member or the like is opened upon the discard of the used stencil in the stencil discharging box according to the embodiment detached from the printing apparatus.

The structure of the present invention will be explained.

Although the detailed internal structure is not illustrated, a stencil printing apparatus 1 (printing apparatus 1) shown in FIGS. 1 and 2 includes a reading section for reading a document image, a plate-making section for making a stencil by perforating an image on a stencil paper according to the image data acquired by the reading section, a printing drum rotatably driven with the made stencil wound therearound, a feeding section for feeding a printing sheet, stacked onto a sheet feeding tray 4, to the printing drum, a discharging section for discharging the printing sheet, having the image printed thereon by the printing drum, and stacking the same onto a sheet discharging tray, and stencil discharging means that peels the used stencil from the printing drum and sends the same to a stencil discharging box 5 for compression.

Figure 12:
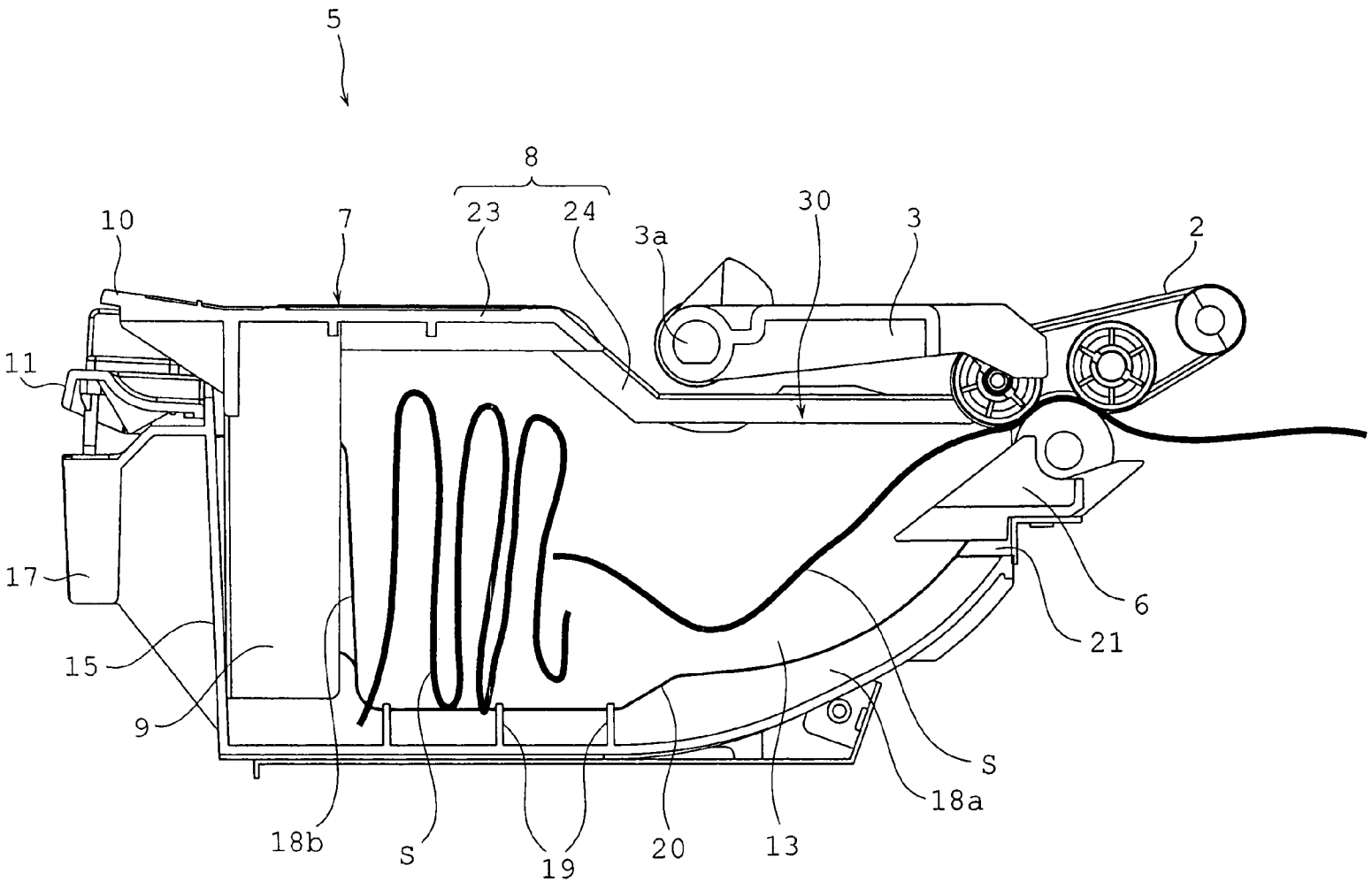
FIG. 12 is a sectional view, viewed from the front, showing the state in which compressing means is not operated in the stencil discharging box according to the embodiment that is attached to the printing apparatus.
Figure 13:
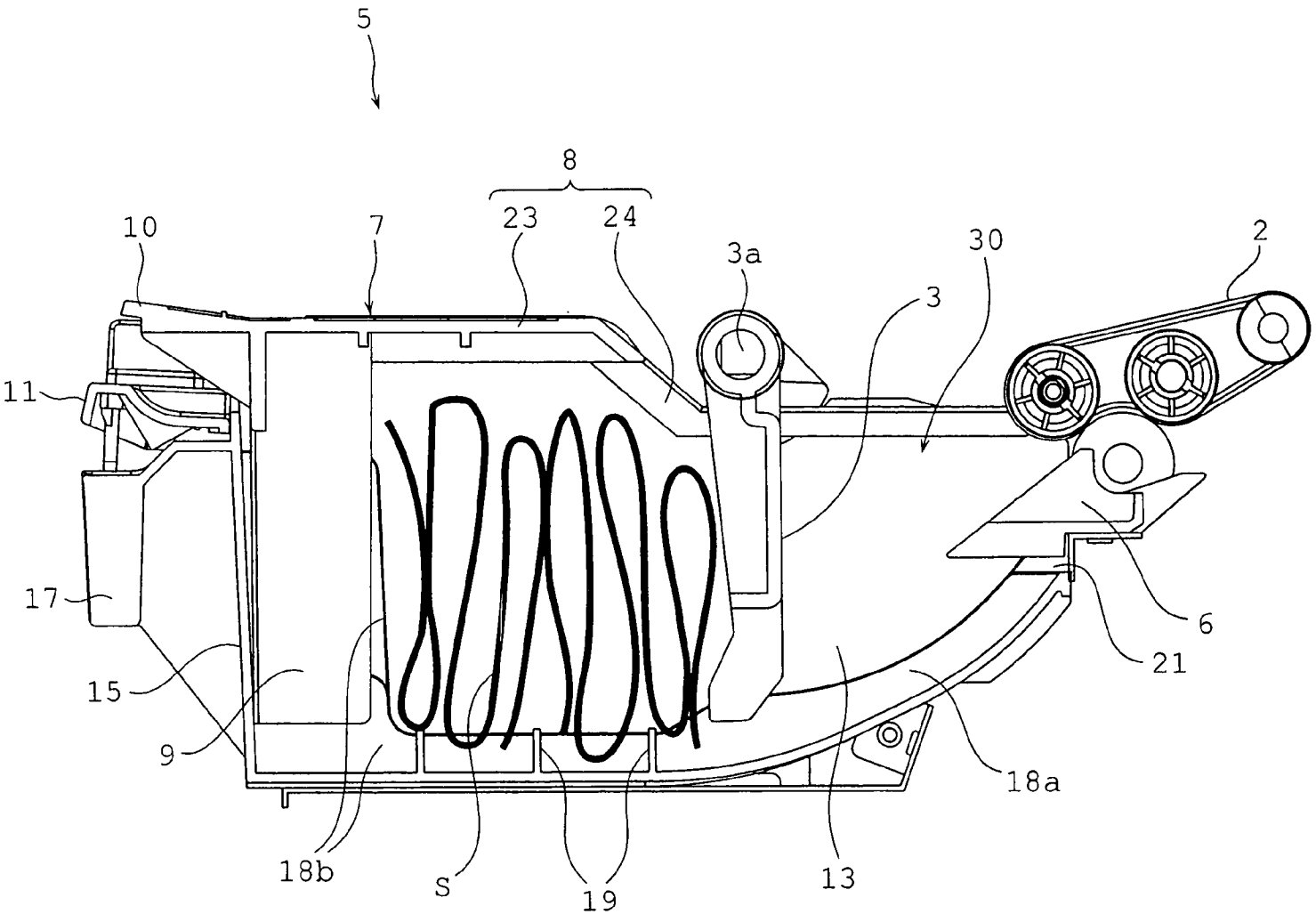
FIG. 13 is a sectional view, viewed from the front, showing the state in which compressing means is operated in the stencil discharging box according to the embodiment that is attached to the printing apparatus.

The stencil discharging means is composed of transporting means 2 and compressing means 3 as shown in FIGS. 12 and 13. The transporting means 2 is configured such that a belt is stretched around plural rollers of plural types provided on plural shafts disposed so as to be parallel to one another, and has a function of sending the used stencil, which is peeled off from the unillustrated printing drum, to the stencil discharging box 5. The compressing means 3 is plural arm-like members equally spaced at a horizontal driving shaft that is orthogonal to the sending direction of the used stencil. The compressing means 3 pivots at an angle of about 90 degrees from the state facing right at the outside of the stencil discharging box 5 as shown in FIG. 12 to the downward state in the stencil discharging box 5 as shown in FIG. 13, so as to compress the used stencil S in the stencil discharging box 5 as sending the used stencil S in the rearward direction. In FIGS. 12 and 13, numeral 6 denotes an anti-return member provided to the printing apparatus 1. It is provided for preventing the used stencil S from being inversely conveyed to the outside of the stencil discharging box 5 when the compressing means 3 returns in the forward direction after the compression.

As shown in FIG. 1, the stencil discharging box 5 is provided at the upper part of the side face of the casing of the stencil printing apparatus 1 to which the sheet feeding tray 4 is mounted. When the discharging stencil box 5 is filled with the used stencil S, or when the maintenance is needed, the stencil discharging box 5 can be removed from the printing apparatus 1 with a one-touch operation by a user with one hand according to a later-described mechanism, as shown in FIG. 2.

The stencil discharging box 5 shown in FIG. 3 in the present embodiment includes a main body 7 that is a casing for accommodating the used stencil S, a cover member 8 mounted so as to be pivotable at the upper face, a stencil moving member 9 that is integrally formed with the cover member 8, an operation lever 10 for operating the cover member 8 and the stencil moving member 9, and an attachment/detachment lever 11 provided to the main body 7 for engaging and releasing the stencil discharging box 5 with and from the printing apparatus 1. The structure and operation of each of the components will be explained below.

As shown in FIGS. 3 and 4, the main body 7 is a casing composed of a bottom plate 12, a pair of side plates (right plate 13, left plate 14), each having a different size, and a rear plate 15. A part of the front face of the main body 7 and the upper part thereof are opened as an upper opening 30 into which the compressing means for compressing the sent used stencil is inserted. The bottom plate 12 that is the bottom portion of the main body 7 is composed of a rear flat plate 12*a* and a front curved plate 12*b* having a shape along the locus of the compressing means. A pair of side plates are parallel to the compressing direction of the compressing means, and composed of the right plate 13 that vertically rises from the flat plate 12*a* of the bottom plate 12 for closing the right side face of the main body 7 and defining one side of the opening at the front face of the main body 7, and the left plate 14 that vertically rises from the flat plate 12*b* of the bottom plate 12 for defining a part of the left side face of the main body 7 as a discharge port 16 that is a discharging section from which the used stencil S is discarded vertically. The rear plate 15 is a plate portion that is provided so as to be opposite to the compressing direction of the compressing means and vertical to the both side plates 13 and 14 and the bottomplate 12, and is a compressing section that receives the used stencil in cooperation with the compressing means in the main body 7 and compresses the same. A grip section 17 that is a hold retained by an operator is mounted so as to be projected from the outer face of the rear plate 15 (rear face of the main body 7).

A great number of bottom ribs 18, which prevents the used stencil S that is sent and compressed from being stuck, are formed at the inner face of the bottom plate 12, which is the bottom portion of the main body 7, so as to be parallel to the compressing direction of the used stencil S by the compressing means 3. The bottom ribs 18*b* formed at the curved plate 12*b* of the bottom plate 12 not only prevent the used stencil S from being stuck, but also have a function of assisting the operation of surely pressing the used stencil S in the rearward direction for compression through the operation of the compressing means 3 pivoting in the main body 7 and going into the bottom ribs 18*b*.

The flat plate 12*a* of the bottom plate 12 at the main body 7 is provided with the bottom ribs 18*b* parallel to the compressing direction and ribs 19 orthogonal to the compressing direction. However, the bottom ribs 18*b* parallel to the compressing direction (i.e., in the direction crossing the discharging direction of the used stencil S) are not formed in the vicinity of the discharge port 16 from which the used stencil S is discharged in the case of the vertical discard, in order to reduce the resistance of the used stencil S, and only the ribs 19 orthogonal to the compressing direction (in the direction parallel to the discharging direction of the used stencil S) are formed.

A great number of compression ribs 18*b* are formed so as to be parallel to the compressing direction of the used stencil S by the compressing means 3 at the inner face of the rear plate 15, which is the compressing section of the main body 7, for preventing the used stencil S from being stuck.

Some of the bottom ribs 18*a* formed at the curved plate 12*b* of the bottom plate 12 are provided with an anti-return projection 20 directing upward. It is configured to prevent the used stencil S, which is sent in the rearward direction as compressed by the compressing means 3, from being returned in the forward direction with the returning movement of the compressing means 3 in the forward direction.

An anti-return claw 21 is arranged so as to face the inlet of the used stencil S between the bottom ribs 18*a* and 18*a* at an appropriate space that is larger than the space between the bottom ribs 18*a* at the front end of the curved plate 12*b* of the bottom plate 12. The anti-return claw 21 prevents, together with the anti-return member 6 mounted to the printing apparatus 1, the used stencil S from being inversely conveyed toward the outside of the stencil discharging box 5, when the compressing means 3 returns in the forward direction after the compression.

As shown in FIGS. 3, 5A and 5B, the cover member 8, the stencil moving member 9, and the operation lever 10, which are integrally formed, are mounted to the inside of the main body 7 and to the upper opening 30 so as to be pivotable.

The cover member 8 shown in FIGS. 5A and 5B is mounted to the upper opening 30 of the main body 7 as shown in FIG. 3. The cover member 8 includes a plate portion 23 that is mounted between the pair of side plates 13 and 14 through the pivot shaft 22 for covering the rear portion of the upper opening 30, and two arm portions 24 that are mounted so as to project forward from the front edge of the plate portion 23 and arranged at a portion of the front portion of the upper opening 30. The operation lever 10 is mounted so as to project rearward at the middle of the rear edge of the plate portion 23 of the cover member 8. Although not shown in detail, biasing means is mounted to the pivot shaft 22. Therefore, in the non-operated state in which the operation lever 10 is not pushed down, the cover member 8 is biased downward by the biasing means, whereby the plate portion 23 closes the rear portion of the upper opening 30 and the arm portions 24 closes a part of the front portion of the upper opening 30 from above in their horizontal states.

Accordingly, in the non-operated state of the operation lever 10 shown in FIG. 3, the cover member 8 is set to the position for closing the upper opening 30 at the upper face of the main body 7 and pressing the used stencil S, which is stored inside, to prevent the used stencil S from being dropped. In the operated state of the operation lever 10 shown in FIG. 6, the cover member 8 pivots in the upward direction apart from the main body 7 to open the upper opening 30 of the main body 7, whereby the used stencil S stored in the main body 7 is easy to be discharged from the discharge port 16 or the upper opening 30.

The stencil moving member 9 shown in FIGS. 5A and 5B is mounted so as to extend generally vertically from the lower face of the plate portion 23 of the cover member 8. The stencil moving member 9 is a member having a shape of reversed C in its horizontal section in which the side of the front face is recessed. In the present embodiment, four stencil moving members 9 in total are mounted at an appropriate space. As shown in FIG. 3, the compression ribs 18*b* formed at the inner face of the rear plate 15 includes four ribs having a small height in the vertical direction and arranged at an appropriate space, whereby spaces are formed. The stencil moving members 9 are arranged at these spaces, wherein the stencil moving members 9 can be moved between a stand-by position at the rearward part in the figure in which the stencil moving members 9 go into the position lower than the height of the compression ribs 18*b* at the inside of the main body 7, and a lift-up position at the front part in the figure in which the stencil moving members 9 project from the height of the compression ribs 18*b*.

Accordingly, in the non-operated state of the operation lever 10 shown in FIG. 3, the stencil moving members 9 are hidden between the compression ribs 18*b* and 18*b* of the rear plate 15 at the inside of the main body 7, while in the operation state of the operation lever 10 shown in FIG. 6, the stencil moving members 9 pivot to project from between the compression ribs 18*b* and 18*b* in the forward direction for lifting and peeling the used stencil S that bites into the compression ribs 18*b* and the bottom ribs 18*a*.

As shown in FIGS. 7 to 11, an attachment/detachment lever 11 is mounted to the main body 7. The attachment/detachment lever 11 executes the engaging operation and releasing operation of an engagement member 25 with and from the printing apparatus 1 through the operation of the engagement member 25 in the form of a claw that is an attachment/detachment mechanism engageable with the printing apparatus 1. The attachment/detachment lever 11 is a longitudinal member having a length corresponding to the whole length of the stencil discharging box 5. The attachment/detachment lever 11 is mounted so as to be pivotable to the outer face (the rear face of the main body 7) of the real plate 15 of the main body 7 above the grip portion 17. The engagement member 25 is mounted to one side of the attachment/detachment lever 11. As shown in FIG. 7, the operation lever 10 is mounted in the vicinity of the portion above the central part of the attachment/detachment lever 11, wherein the attachment/detachment lever 11 and the operation lever 10 can easily be operated by fingers of the same hand when the grip portion 17 is gripped by one hand for the operation.

A locking mechanism having a structure of advancing or withdrawing a locking member 27 by a slide lever 26 is mounted at the upper face of one side of the attachment/detachment lever 11. When the stencil discharging box 5 is attached to the printing apparatus 1, the engagement member 25 is engaged with the printing apparatus 1, and the slide lever 26 is moved to the locking side to lock the locking member 27 to the printing apparatus, the stencil discharging box 5 cannot be detached from the printing apparatus 1 just by gripping the attachment/detachment lever 11 and disengaging the engagement member 25, unless the locking member 27 is released.

Subsequently, the operation of the present embodiment will be explained.

As shown in FIG. 1, when the stencil discharging box 5 is mounted to the predetermined position of the printing apparatus 1, the state and relative arrangement of the stencil discharging box 5 and stencil discharging means involved with the used stencil S in the printing apparatus 1 are as illustrated in FIG. 12. Specifically, since the operation lever 10 is not pushed, the cover member 8 covers the upper opening 30 of the main body 7, and the stencil moving members 9 are hidden between the compression ribs 18*b* and 18*b* at the rear plate 15 in the main body 7. Further, the transporting means 2 of the printing apparatus 1 is arranged at the front portion of the upper opening 30 of the stencil discharging box 5, and the anti-return member 6 of the printing apparatus 1 is arranged side by side alternately with the anti-return claw 21 of the stencil discharging box 5 in order to prevent the used stencil S from being inversely conveyed to the outside of the stencil discharging box 5. The compressing means 3 is arranged above the stencil discharging box 5 that is the stand-by position before the compression.

When the printing apparatus 1 is operated, the transporting means 2 sends the used stencil S into the stencil discharging box 5 at an appropriate timing as shown in FIG. 12. Then, as shown in FIG. 13, the compressing means 3 is operated to compress the used stencil S in the stencil discharging box 5 as pushing the same in the rearward direction. The leading end of the compressing means 3 is inserted in a telescopic manner between the bottom ribs 18*a* of the bottom plate 12 of the stencil discharging box 5, so that the all of the used stencils S are conveyed in the rearward direction and surely compressed between the compressing means 3 and the rear plate 15 that is the compressing section.

The compressing means 3 pivots in the near side to return to the stand-by position after the compression. Since the anti-return projection 20 is provided to the bottom rib 18*a* of the stencil discharging box 5 as shown in FIG. 12, the used stencil S stays at least at the anti-return projection 20, even if the used stencil S, which is compressed and conveyed in the rearward direction, is dragged by the compressing means 3 to return in the forward direction, whereby it is prevented that the used stencil S is returned in the forward direction with the return of the compressing means 3 in the forward direction.

The stencil discharging box 5 is filled with the used stencil S after the used stencils S are repeatedly received and compressed. The filling state is detected by detecting means, not shown, and an alarm is displayed on a display section of the printing apparatus 1. The user detaches the stencil discharging box 5 from the printing apparatus 1 and discards the used stencils S therein according to the alarm.

FIGS. 7 and 8 show the state in which the stencil discharging box 5 is mounted to the printing apparatus 1, and locked by the slide lever 26 and the locking member 27. In order to remove the locked stencil discharging box 5 from the printing apparatus 1, the user moves the slide lever 26 in the rightward direction to retreat the locking member 27 into the stencil discharging box 5 so as to release the locking state as shown in FIGS. 9 and 10, and then, the user grips the attachment/detachment lever 11 with one hand (not shown) to pivot the attachment/detachment lever 11 in the direction nearer to the grip portion 17 as shown in FIG. 11. With this operation, the engagement member 25 pivots in the upward direction to be released from the printing apparatus 1. Therefore, when the user pulls the attachment/detachment lever 11 in the near direction with one hand, the stencil discharging box 5 can be detached from the printing apparatus 1.

As shown in FIG. 14, the compressed used stencils S bite into the recess portion among the bottom ribs 18*a*, ribs 19 and compression ribs 18*b* in the stencil discharging box 5 detached from the printing apparatus 1, and the cover member 8 covers the upper opening 30 of the main body 7 so as to surely press the used stencils S from above. Therefore, the used stencils S stored inside cannot be dropped off to the outside just by the force applied by the detaching operation.

As shown in FIG. 15, the user releases his/her fingers from the attachment/detachment lever 11 while gripping the stencil discharging box 5 with the hand that is used for detaching the stencil discharging box 5 from the printing apparatus 1, and then, depresses the operation lever 11. The cover member 8 moves upward, so that the holding force of the used stencils S is no more applied. In the main body 7, the stencil moving members 9 advance forward from between the compression ribs 18*b* and pivot in the upward direction so as to lift up the used stencils S from below. Therefore, the used stencils S biting into the bottom ribs 18*a*, ribs 19 and compression ribs 18*b* can be peeled, so that the resistance for the movement can be eliminated.

When the user tilts the main body 7 in such a manner that the discharge port 16 at the side face faces downward as gripping the stencil discharging box 5 with one hand, the user can execute the vertical discard in which the used stencils S are discharged from the discharge port 16 at the side face along the direction shown by an arrow A in FIG. 6. Specifically, if the used stencils S bite into the bottom ribs 18*a*, ribs 19 and compression ribs 18*b* in the main body 7, and hence, the used stencils S cannot be moved toward the discharge port 16 even if the main body 7 is tilted, the used stencils S can be lifted up by the stencil moving members 9 by the operation of the operation lever 10 so as to peel the used stencils S from the bottom ribs 18*a*, ribs 19 and compression ribs 18*b*. Therefore, when the main body 7 is tilted afterward, the used stencils S lifted from the bottom ribs 18*a*, ribs 19 and compression ribs 18*b* can be discharged to the outside from the discharge port 16 without resistance.

In the present embodiment, the bottom ribs 18*a* in the direction parallel to the compressing direction are not formed in the vicinity of the discharge port 16 at the side face, which is the discharge port 16 in the case of the vertical discard, whereby the condition in which the used stencils S bite into the bottom ribs 18*a* is not produced. Accordingly, the resistance of the used stencils S upon peeling the used stencils S from the ribs 19 by the stencil moving members 9 is small, with the result that the used stencils S can easily be peeled, even if they are stuck. Consequently, the used stencils S in the vicinity of the discharge port 16 can be discharged from the discharge port 16 more easily than the other sections just by tilting the main body 7. If the leading end once goes out of the discharge port 16, the trailing part is easily and continuously pushed by its own weight, whereby the vertical discard can easily be carried out.

The user can attach the stencil discharging box 5 in the present embodiment to the printing apparatus 1 as gripping the same with one hand after the used stencils S are discharged.

As described above, according to the stencil discharging box 5 in the present embodiment, the user operates the attachment/detachment lever 11 with one hand as griping the grip portion 17 of the main body 7, whereby the engagement member 25 can be released from the printing apparatus 1, and hence, the stencil discharging box 5 can easily be detached from the printing apparatus 1. After that, with the grip portion 17 of the main body 7 gripped, the user tilts the main body 7 with the discharge port 16 facing downward while operating the operation lever 10 with the same hand, with the result that vertical discard in which the used stencils S are lifted up from the bottom ribs 18*a*, ribs 19 and compression ribs 18*a* and discharged at once to the outside from the discharge port 16 at the side face of the main body 7 can be smoothly executed.

During the operation of the operation lever 10, when the main body 7 is tilted in such a manner that the opening into which the stencils are sent to the main body 7 faces downward, the used stencils S are moved in the direction shown by an arrow B in FIG. 6 reverse to the accepting direction (or the compressing direction) of the used stencils S so as to execute a lateral discard in which the used stencils S are discharged from the inlet.

2. Modification of Main Body 7 (FIGS. 16 and 17)

Next, a modification in which a part of the above-mentioned embodiment is modified will be explained.

Figure 16:
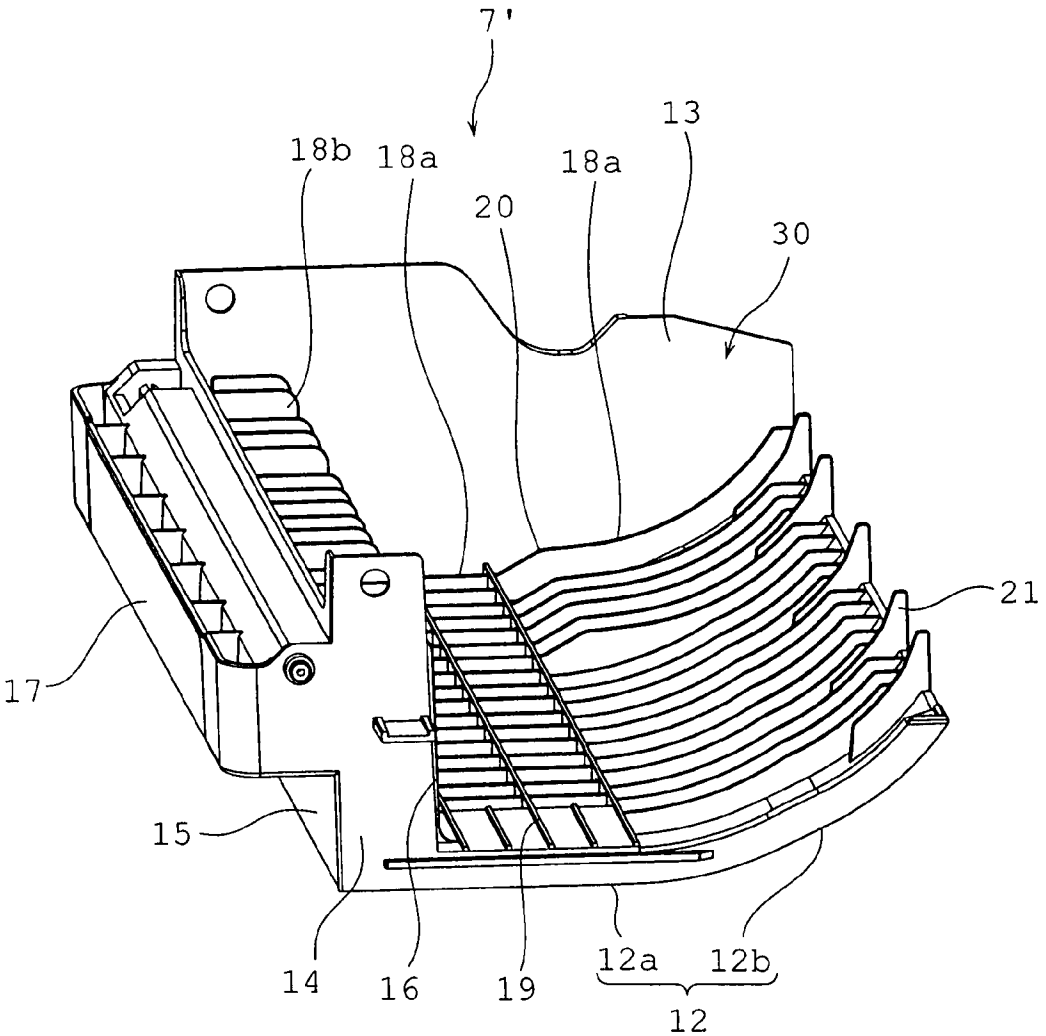
FIG. 16 is a perspective view showing a modification of a structure of a rib and other members in the main body.

FIG. 16 shows a main body 7' in the modification in which, in the structure of the main body 7 shown in FIG. 4, the anti-return projection 20 for preventing the return of the used stencil S is formed only at the bottom ribs 18*a* at the far side (at the side of the side plate 13) of the curved plate 12 of the bottom plate 12. If the anti-return projection 20 is not formed at the bottom ribs 18*a* close to the discharge port 16, the resistance upon the discharge is reduced in the vertical discard, whereby the modification provides an effect of being capable of more smoothly executing the vertical discard compared to the embodiment.

Figure 17:
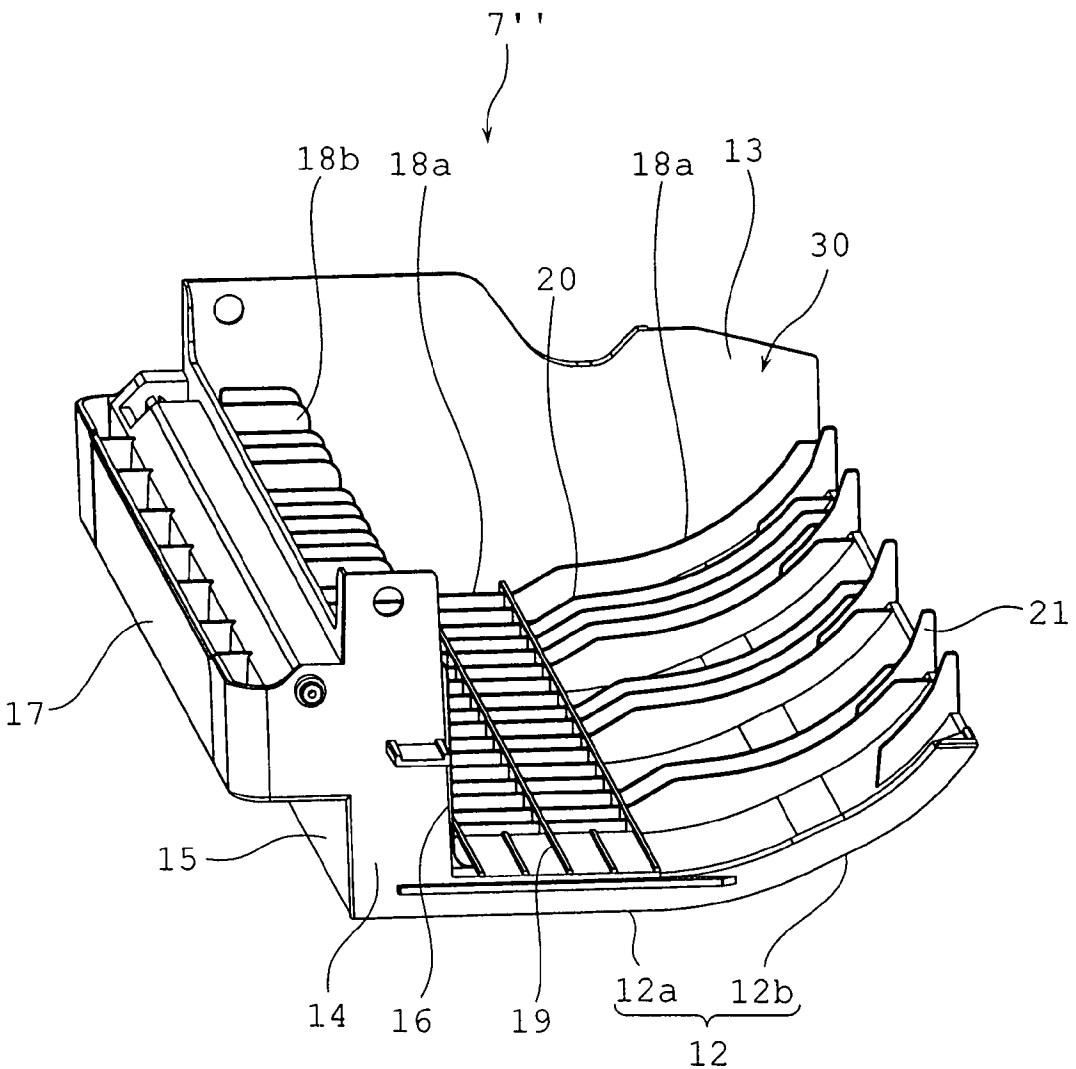
FIG. 17 is a perspective view showing another modification of a structure of a rib and other members in the main body.

FIG. 17 shows a main body 7" in the modification in which, in the structure of the main body 7 shown in FIG. 4, the bottom ribs 18*a* at the curved plate 12*b* of the bottom plate 12 are appropriately thinned in such a manner that the number of the bottom ribs 18*b* close to the discharge port 16 is reduced and the number of the bottom ribs 18*b* at the far side is increased. If the number of the bottom ribs 18*b* close to the discharge port 16 is reduced, the resistance upon the discharge is reduced in the vertical discard, whereby the modification provides an effect of being capable of more smoothly executing the vertical discard compared to the embodiment.

3. Modification of Stencil Moving Member 9 (FIGS. 18A, 18B and 19)

Next, a modification in which a part of the above-mentioned embodiment is modified will be explained.

Figure 18A:
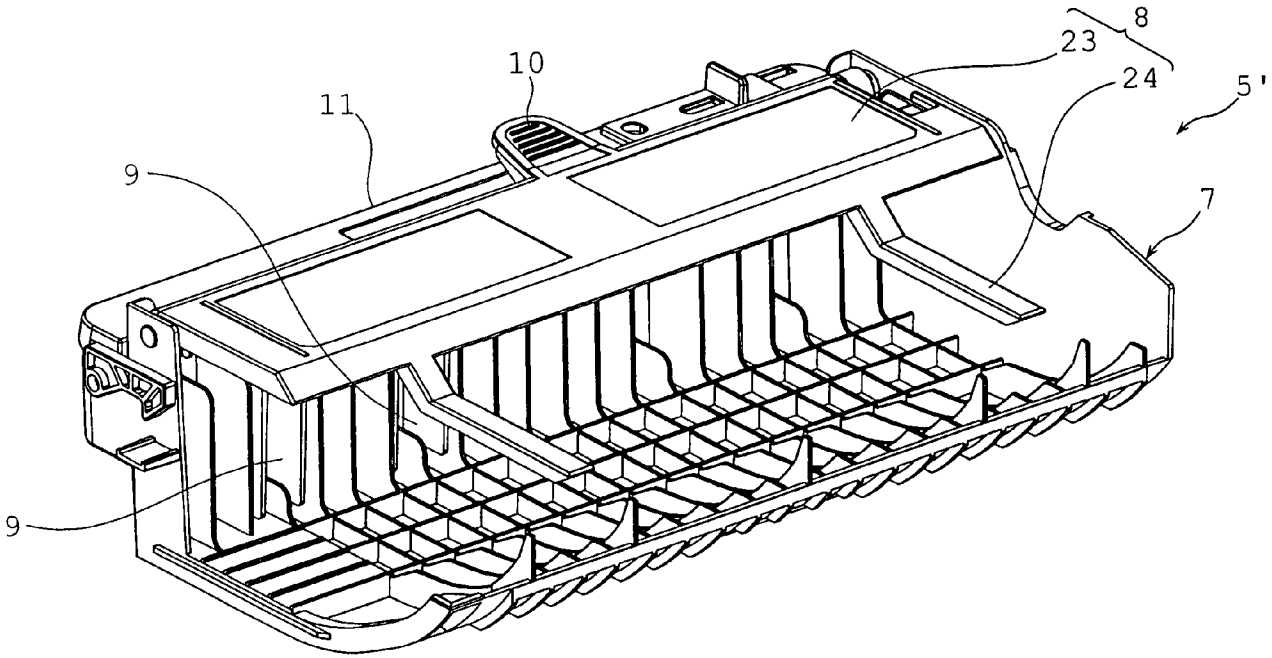
FIGS. 18A and 18B are perspective views showing a modification of a structure of a stencil moving member in the main body.
Figure 18B:
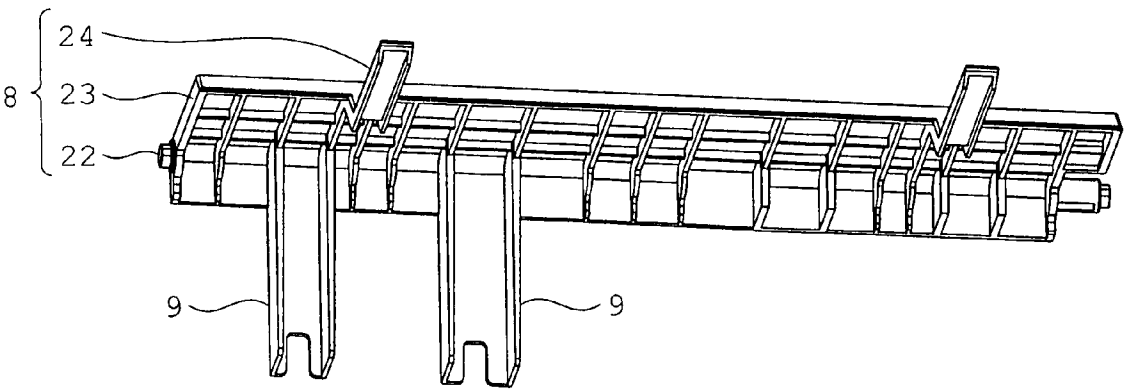
Figure 19:
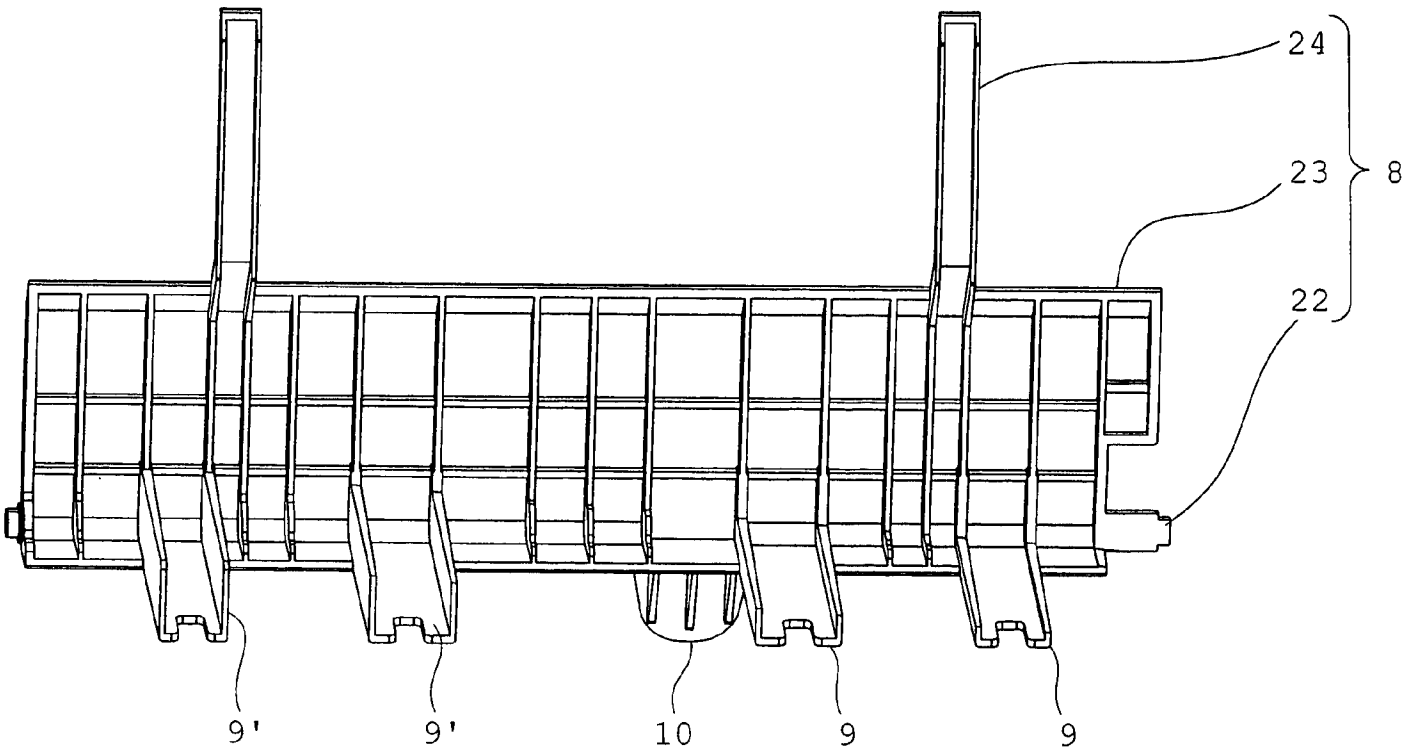
FIG. 19 is a perspective view showing another modification of a structure of a stencil moving member in the main body.

FIGS. 18A and 18B show a stencil discharging box 5' in the modification in which, in the structure shown in FIG. 3, two stencil moving members 9 are formed at the position relatively close to the discharge port 16 and no stencil moving member 9 is formed at the position relatively far from the discharge port 16 in the direction orthogonal to the compressing direction (in the direction of vertical discard). FIG. 18A is an overall perspective view of the stencil discharging box 5', and FIG. 18B is a perspective view of the cover member 8 and the stencil moving member 9 that are integrally formed.

According to this modification, the stencil moving members 9 are formed only at the position close to the discharge port 16 for the vertical discard. Therefore, even if the used stencils S bite into the bottom ribs 18*a*, ribs 19 and compression ribs 18*b* in the main body 7 in the vicinity of the discharge port 16 when the vertical discard is to be executed, the used stencils S can be lifted up and peeled off from the bottom ribs 18*a*, ribs 19 and compression ribs 18*b*, whereby the vertical discard can be executed. Specifically, the used stencils S in the vicinity of the discharge port 16 can surely be lifted up from the bottom ribs 18*a*, ribs 19 and compression ribs 18*b* by the operation of the operation lever 10, so that the leading end of the used stencil S that is no more hooked with the main body 7 through the lift-up operation moves without resistance and can be discharged to the outside from the discharge port 16, when the main body 7 is tilted with the discharge port 16 facing downward. Accordingly, the whole used stencil S moves by its own weight and can smoothly be discharged from the discharge port 16.

FIG. 19 is another modification of the stencil moving member 9. The modification is the same as the embodiment (FIGS. 3, 5A and 5B) in that plural stencil moving members 9 are formed at plural positions in the direction orthogonal to the compressing direction, but the modification has a feature that the size of the stencil moving member 9' formed at the position relatively close to the discharge port 16 is longer than the size of the stencil moving member 9 formed at the position relatively far from the discharge port 16 in the compressing direction (the length in the direction of moving the stencil moving member 9).

According to this modification, even if the used stencils S bite into the bottom ribs 18*a*, ribs 19, and compression ribs 18*b* in the main body 7 upon the vertical discard, the stencil moving member 9' formed at the position relatively close to the discharge port 16 is firstly brought into contact with the used stencils S biting into the bottom ribs 18*a*, ribs 19 and the compression ribs 18*b* through the operation of the operation lever 10, so that the stencil moving member 9' formed at the position relatively close to the discharge port 16 firstly lifts up the used stencils S from the bottom ribs 18*a*, ribs 19 and compression ribs 18*b* at the position near the discharge port 16. The lift-up amount by the stencil moving member 9' close to the discharge port 16 is greater than that by the stencil moving member 9 far from the discharge port 16. Accordingly, the used stencils S are greatly lifted up from the bottom ribs 18*a* and the ribs 19 in the vicinity of the discharge port 16 through the operation of the operation lever 10 upon the vertical discarding, so that the leading end of the used stencil S that is no more hooked with the main body 7 through the lift-up operation moves without resistance and can be discharged to the outside from the discharge port 16, when the main body 7 is tilted with the discharge port 16 facing downward. Accordingly, the whole used stencil S moves by its own weight and can smoothly be discharged from the discharge port 16.

As apparent from the description of the present embodiment, the operation and effect described below can be obtained according to the present invention.

According to the stencil discharging box described in claim 1, when a user grips the main body with one hand to remove the same from the printing apparatus, and operates the operation lever with the same hand gripping the main body, vertical discard in which a used stencil can be discharged and discarded to the outside from the discharging section at a side face can be executed. Specifically, even if the used stencil cannot move toward the discharging section even by tilting the main body, i.e., the used stencil bites into the bottom rib and the compression rib in the main body, the stencil moving member moves in the direction of projecting from between the compression ribs in the main body through the operation of the operation lever so as to lift up the used stencil that gets caught by the bottom rib or the compression rib and peel the used stencil from the bottom rib and the compression rib. Accordingly, by tilting the main body with the discharging section facing downward after that, the used stencil lifted up from the rib is discharged to the outside from the discharging section without any resistance. After the used stencil is discharged, the user can attach the stencil discharging box to the printing apparatus while gripping the same with the same single hand, which is extremely convenient.

According to the stencil discharging box described in claim 2, the stencil moving member is formed at the position close to the discharging section that is an outlet of the used stencil upon the vertical discard. Therefore, even if the used stencil bites into the bottom rib and the compression rib in the main body in the vicinity of the discharging section when the used stencil is subject to the vertical discard, the used stencil can be lifted up to be peeled off from the bottom rib and the compression rib, and can be vertically discarded. Specifically, if the used stencil is lifted up from the bottom rib and the compression rib at least in the vicinity of the discharging section through the operation of the operation lever, the leading end of the used stencil that is no more hooked with the main body through the lift-up operation moves without any resistance and can be discharged to the outside from the discharging section, when the main body is tilted with the discharging section facing downward. Accordingly, the whole used stencil moves by its own weight and can smoothly be discharged from the discharging section.

According to the stencil discharging box described in claim 3, in the case where the stencil moving member is provided at plural positions in the direction orthogonal to the compressing direction, the length of the stencil moving member provided at the position close to the discharging section, which is an outlet of the used stencil upon the vertical discard, in the compressing direction is larger than the length of the stencil moving member provided at the position far from the discharging section in the compressing direction. Therefore, even if the used stencil bites into the bottom rib and the compression rib in the main body upon the vertical discard, the stencil moving member formed at the position close to the discharging section is firstly brought into contact with the used stencil biting into the bottom rib and the compression rib through the operation of the operation lever, so that the stencil moving member formed at the position close to the discharging section firstly lifts up the used stencil from the bottom rib and compression rib at the position near the discharging section. The lift-up amount by the stencil moving member close to the discharging section is greater than that by the stencil moving member far from the discharging section. Accordingly, the used stencil is greatly lifted up from the bottom rib and the compression rib in the vicinity of the discharging section through the operation of the operation lever upon the vertical discard, so that the leading end of the used stencil that is no more hooked with the main body through the lift-up operation moves without any resistance and can be discharged to the outside from the discharging section, when the main body is tilted with the discharging section facing downward. Accordingly, the whole used stencil moves by its own weight and can smoothly be discharged from the discharging section.

According to the stencil discharging box described in claim 4, the cover member covers the upper opening of the main body at the position not interfering the compressing operation by the compressing means of the printing apparatus with the stencil discharging box attached to the printing apparatus. Therefore, the compressing means of the printing apparatus can compress the used stencil in the stencil discharging box without any difficulty. The cover member is at the closing position for covering the upper opening until the stencil discharging box is detached from the printing apparatus for carrying out the vertical discard, so that the cover member presses the used stencil stored in the main body from above. Therefore, there is no fear of the used stencil from dropping to the outside. When the stencil discharging box is detached from the printing apparatus for carrying out the vertical discard, the cover member moves to the opening position for opening the upper opening in interlocking with the movement of the stencil moving member by the operation of the operation lever so as to release the holding to the used stencil. Therefore, this structure provides an effect that the vertical discard in which the used stencil is fallen from the discharge port can easily be carried out.

During the operation of the operation lever, when the main body is tilted in such a manner that the opening into which the stencils are sent to the main body faces downward, the used stencil is moved in the direction reverse to the accepting direction (or the compressing direction) of the used stencil so as to execute a lateral discard in which the used stencil is discharged from the inlet.

According to the stencil discharging box described in claim 5, a user operates the attachment/detachment lever with one hand while gripping the main body, whereby the attachment/detachment mechanism is released from the printing apparatus, and hence, the main body can easily be detached from the printing apparatus. When the user operates the operation lever provided in the vicinity of the attachment/detachment lever with the same one hand while gripping the main body, and tilts the main body in such a manner that the discharge port faces downward, the used stencil can be lifted up from the bottom rib and the compression rib to be vertically discarded at once to the outside from the discharging section at the side face of the main body. As described above, the apparatus locked to the printing apparatus can be detached by a series of operations with one hand, and the operation for lifting up the used stencil from the bottom rib and the compression rib and discharging at once the used stencil from the discharging section at the side face in the direction orthogonal to the compressing direction can smoothly be performed.

According to the stencil discharging box described in claim 6, when the locking mechanism is operated, the operation of the attachment/detachment lever is inhibited, whereby the erroneous detachment of the stencil discharging box from the printing apparatus can be avoided.

According to the stencil discharging box described in claim 7, the bottom rib that is parallel to the compressing direction is not formed at the position near the discharging section that is the outlet of the used stencil in the vertical discard, whereby the used stencil is easy to be discharged from the discharge port, and hence, the vertical discard can easily be performed.

According to the stencil discharging box described in claim 8, the anti-return projection is formed to the bottom rib, which prevents the compressed used stencil from returning to the upper opening.

According to the stencil printing apparatus described in claim 9, and including a printing drum, a detachable stencil discharging box, and compressing means that compresses the used stencil peeled from the printing drum and stored in the stencil discharging box, when a user grips a main body of the stencil discharging box with one hand to remove the same from the printing apparatus, and operates an operation lever with the same hand gripping the main body of the stencil discharging box, vertical discard in which a used stencil can be discharged and discarded to the outside from a discharging section at a side face can be executed. Specifically, even if the used stencil cannot move toward the discharging section even by tilting the main body of the stencil discharging box, i.e., the used stencil bites into the bottom rib and the compression rib in the main body of the stencil discharging box, the stencil moving member moves in the direction of projecting from between the compression ribs in the main body of the stencil discharging box through the operation of the operation lever so as to lift up the used stencil that gets caught by the bottom rib or the compression rib and peel the used stencil from the bottom rib and the compression rib. Accordingly, by tilting the main body of the stencil discharging box with the discharging section facing downward after that, the used stencil lifted up from the rib is discharged to the outside from the discharging section without any resistance. After the used stencil is discharged, the user can attach the stencil discharging box to the printing apparatus as gripping the same with the same single hand, which is extremely convenient.

According to the stencil receiving apparatus described in claim 10, when a user grips the stencil receiving container with one hand to remove the same from the printing apparatus, and operates the stencil moving operation section with the same hand gripping the stencil receiving container, vertical discard in which a used stencil can be discharged and discarded to the outside from the stencil discarding section at the side section for receiving the used stencil can be executed. Specifically, even if the used stencil cannot move toward the stencil discarding section even by tilting the stencil receiving container, i.e., the used stencil bites into the rib at the bottom section for receiving the stencil and the facing section rib in the main body, the stencil moving member moves in the direction of projecting from between the facing section ribs in the stencil receiving container through the operation of the stencil moving operation section so as to lift up the used stencil that gets caught by the rib at the bottom section for receiving the stencil or the facing section rib and peel the used stencil from the rib at the bottom section for receiving the stencil and the facing section rib. Accordingly, by tilting the stencil receiving container with the stencil discarding section facing downward after that, the used stencil lifted up from the rib is discharged to the outside from the stencil discarding section without any resistance. After the used stencil is discharged, the user can attach the stencil receiving container to the main body of the printing apparatus while gripping the same with the same single hand, which is extremely convenient.

What is claimed is:

1. A stencil receiving apparatus that is configured to be detachably mounted to a printing apparatus for receiving a stencil discharged from said printing apparatus, comprising:

a stencil receiving container that has a main body including a bottom section for receiving the stencil, a facing section for receiving the stencil arranged at said bottom section for receiving the stencil so as to be opposite to a stencil receiving direction, a pair of side sections arranged at two side faces of said bottom section parallel to the stencil receiving direction, a stencil discarding section provided at at least one of the side sections for discarding the stencil in a direction orthogonal to the stencil receiving direction, and an upper opening formed by a part of a front face of the main body and an upper part of the main body, the stencil receiving container being arranged to be removed from the printing apparatus in a direction parallel to a compressing direction of the stencil;

an attachment/detachment operation section that is arranged at said stencil receiving container at a side of said facing section for receiving the stencil and used when said stencil receiving apparatus is attached to or detached from said printing apparatus; and a cover member including a plate section covering a rear portion of the upper opening of the main body, an arm section extending forwardly from the plate section to cover at least partly a front portion of the upper opening, a stencil moving section that is arranged at said stencil receiving container at the side of said facing section for receiving the stencil and moves the received stencil into said stencil receiving container towards a direction opposite to the stencil receiving direction, and a stencil moving operation section that is arranged at said stencil receiving container at the side of said facing section and operates said stencil moving section, the plate section, and the arm section, wherein the cover member is arranged to cover the upper opening with the plate section and the arm section and to place the stencil moving section in said facing section when the stencil moving operation section is not operated, and to open the upper opening and to move the stencil moving section into the stencil receiving container by lifting the plate section and the arm section when the stencil moving operation section is operated, and the stencil receiving container is arranged to be removed by holding the attachment/detachment operation section by one hand and to discharge a used stencil from the stencil receiving container while tilting the stencil receiving container so that the stencil discarding section is oriented downwardly.

2. A stencil discharging box detachably mounted to a printing apparatus for receiving a used stencil sent from said printing apparatus having a compressing device for compressing said used stencil, comprising:

a main body including a bottom section having a shape to receive the used stencil compressed by the compressing device, a facing section extending upwardly from the bottom section and located at a position facing the compressing device in a compressing direction of the compressing device, a pair of side faces extending upwardly from the bottom section and located at two sides of the facing section parallel to the compressing direction, a discharging section of the used stencil provided at at least one of the side faces for discharging the used stencil in a direction orthogonal to the compressing direction, a plurality of bottom ribs formed at the bottom section so as to extend in a same direction as the compressing direction, a plurality of facing section ribs formed at the facing section for receiving the stencil, and an upper opening located at an upper portion of the bottom section into which the compressing device is inserted for compressing the used stencil with the compressing device, the stencil discharging box being arranged to be removed from the printing apparatus in a direction parallel to the compressing direction of the compressing device;

a cover member including a plate section covering a rear portion of the upper opening of the main body, an arm section extending forwardly from the plate section to cover at least partly a front portion of the upper opening, a stencil moving member movable between a stand-by position in which the stencil moving member is inserted at a position lower than a height of the facing section rib and a lift-up position in which the stencil moving member projects from the height of said facing section rib, and an operation lever for moving said stencil moving member; and an attachment/detachment lever provided on a rear surface of the facing section and having an attachment/detachment mechanism for attaching and detaching said stencil discharging box to and from said printing apparatus, wherein the cover member is arranged to cover the upper opening with the plate section and the arm section and to place the stencil moving member in said facing section when the operation lever is not operated, and to open the upper opening and to lift the stencil moving member to the lift-up position by lifting the plate section and the arm section when the operation lever is operated, and the stencil discharging box is arranged to be removed by holding the attachment/detachment lever by one hand and to discharge the used stencil from the stencil discharging box while tilting the stencil discharging box so that the discharging section is oriented downwardly.

3. The stencil discharging box according to claim 2, wherein said stencil moving member is provided at a position near said discharging section in the direction orthogonal to said compressing direction.

4. The stencil discharging box according to claim 3, wherein said stencil moving member includes a plurality of stencil moving members in the direction orthogonal to said compressing direction, and a length of the stencil moving member, among the plurality of stencil moving members, in said compressing direction provided at the position near said discharging section is longer than a length of the stencil moving member provided at a position far from said discharging section.

5. The stencil discharging box according to claim 2, wherein said cover member covers said upper opening at a position not interfering the compressing operation by said compressing device, and said cover member is movable to be opened and closed between an opening position for opening said upper opening and a closing position for covering said upper opening, and opens and closes said upper opening through the operation of said operation lever in interlocking with said stencil moving member.

6. The stencil discharging box according to claim 5, wherein said operation lever is provided in the vicinity of said attachment/detachment lever.

7. The stencil discharging box according to claim 6, wherein a locking mechanism for inhibiting an operation of said attachment/detachment lever is provided to said attachment/detachment lever.

8. The stencil discharging box according to claim 7, wherein said plurality of bottom ribs are formed at a position other than the position near said discharging section in the direction orthogonal to said compressing direction.

9. The stencil discharging box according to claim 8, wherein an anti-return projection for preventing the compressed used stencil from returning to the upper opening is provided to said plurality of bottom ribs.

10. A stencil printing apparatus, comprising:

a printing drum;

a detachable stencil discharging box; and a compressing device that compresses a used stencil peeled off from said printing drum and stored in said stencil discharging box, wherein the stencil discharging box comprises a main body including a bottom section having a shape to receive the used stencil compressed by the compressing device, a facing section extending upwardly from the bottom section and located at a position facing the compressing device in a compressing direction of the compressing device, a pair of side faces extending upwardly from the bottom section and located at two sides of the facing section parallel to the compressing direction, a discharging section of the used stencil provided at at least one of the side faces for discharging the used stencil in a direction orthogonal to the compressing direction, a plurality of bottom ribs formed at the bottom section so as to extend in a same direction as the compressing direction, a plurality of facing section ribs formed at the facing section for receiving the used stencil, and an upper opening located at an upper portion of the bottom section into which the compressing device is inserted for compressing the used stencil with the compressing device, and the stencil discharging box being arranged to be removed from the printing apparatus in a direction parallel to the compressing direction of the compressing device, a cover member including a plate section covering a rear portion of the upper opening of the main body, an arm section extending forwardly from the plate section to cover at least partly a front portion of the upper opening, a stencil moving member movable between a stand-by position in which the stencil moving member is inserted at a position lower than a height of the facing section rib and a lift-up position in which the stencil moving member projects from the height of said facing section rib, and an operation lever for moving said stencil moving member, and an attachment/detachment lever provided on a rear surface of the facing section and having an attachment/detachment mechanism for attaching and detaching said stencil discharging box to and from said printing apparatus, wherein the cover member is arranged to cover the upper opening with the plate section and the arm section and to place the stencil moving member in said facing section when the operation lever is not operated, and to open the upper opening and to lift the stencil moving member to the lift-up position by lifting the plate section and the arm section when the operation lever is operated, and the stencil discharging box is arranged to be removed by holding the attachment/detachment lever by one hand and to discharge the used stencil from the stencil discharging box while tilting the stencil discharging box so that the discharging stencil section is oriented downwardly.

* * * * *